US008388362B2

(12) United States Patent
Su

(10) Patent No.: US 8,388,362 B2
(45) Date of Patent: Mar. 5, 2013

(54) STACKED CARD-EDGE CONNECTOR AND CARD LATCHING DEVICE

(75) Inventor: Yu Sheng Su, Taipei (TW)

(73) Assignee: Tyco Holdings (Bermuda) No. 7 Limited, Pembroke (BM)

( * ) Notice: Subject to any disclaimer, the term of this patent is extended or adjusted under 35 U.S.C. 154(b) by 131 days.

(21) Appl. No.: 13/095,493

(22) Filed: Apr. 27, 2011

(65) Prior Publication Data

US 2011/0263146 A1 Oct. 27, 2011

(30) Foreign Application Priority Data

Apr. 27, 2010 (TW) ..... 99113227 A

(51) Int. Cl.
*H01R 13/62* (2006.01)

(52) U.S. Cl. ..... 439/153; 439/328

(58) Field of Classification Search ..... 439/153, 439/137, 138, 327, 328
See application file for complete search history.

(56) References Cited

U.S. PATENT DOCUMENTS 5,655,918 A * 8/1997 Soh ..... 439/159
6,319,035 B1 11/2001 Choy
6,648,680 B1 * 11/2003 Hu ..... 439/541.5
7,841,895 B2 * 11/2010 Zhu et al. ..... 439/541.5

* cited by examiner

*Primary Examiner* — Tulsidas C Patel
*Assistant Examiner* — Travis Chambers
(74) *Attorney, Agent, or Firm* — Barley Snyder

(57) ABSTRACT

A stacked card-edge connector is provided for fixing and electrically connecting at least one electronic card to a circuit board. The stacked card-edge connector includes two stackable and interchangeable insulating housings, a pair of first card latches, a pair of second card latches, a pair of fasteners. The pair of first card latches are mounted respectively at the two sides of one insulating housing for fixing and/or holding the at least one electronic card. The pair of second card latches are secured respectively at the two sides of the other insulating housing for fixing and/or holding another electronic card. When two electronic cards are secured respectively by the pair of first and second card latches, disengagement of the electronic card secured by pair of first card latches causes a simultaneous disengagement of the electronic card secured by the pair of second card latches.

26 Claims, 26 Drawing Sheets

STACKED CARD-EDGE CONNECTOR AND CARD LATCHING DEVICE

CROSS-REFERENCE TO RELATED APPLICATION

This application claims the benefit of the filing date under 35 U.S.C. §119(a)-(d) of Taiwan Utility Model Application No. 99113227, filed Apr. 27, 2010.

FIELD OF THE INVENTION

The present invention relates to a card-edge connector, and more particularly, to a stacked card-edge connector capable of simultaneously ejecting the upper and lower electronic cards.

BACKGROUND

A main circuit board in known typical electronic devices is generally provided with different card-edge connectors in order receive various modular electronic cards. The electrical contacts on front edges of the cards can electrically contact with corresponding conductive terminals on the card-edge connectors to achieve electrically conduction between the electrical cards and the main circuit board. Therefore, the card-edge connector not only includes a coupling having a plurality of conductive terminals, but also includes a locking member for retaining the electronic card.

In order to satisfy customers' demand for well-functionalized electronic devices, electronic devices are equipped with more and more functions, and thus need to be capable of operating two cards. Therefore, a need exists in the art for a stacked card-edge connector for mounting two electronic cards in a stacked manner.

U.S. Pat. No. 6,319,035 has disclosed a stacked connector assembly having an upper insulative housing and a lower insulative housing, which are formed integrally with each other. As the integrally formed housing is larger, it becomes curved during the injection molding process, thus flatness of the surface is not well controlled and the ability to weld to the printed circuit board cannot be controlled easily, as well. Consequently, the welding of the card-edge connector to the printed circuit board will be affected. Moreover, the upper and lower insulative housings of a conventional connector assembly are provided with locking openings, so as to be secured to the printed circuit board in order to maintain a stable electrical connection between the connector and the printed circuit board, thereby the connector that is welded to the printed circuit board through the pins of a plurality of conductive terminals will not separate from the printed circuit board easily. However, the locations of the locking openings formed on the upper and lower insulative housings are unchangeable, and the application of the upper and lower insulative housings is limited and the securing structure is more complicated.

Furthermore, the upper and lower insulative housings are of different structures and need to be manufactured using different molds. As a result, the production cost is high. In addition, since the upper and lower insulative housings are not identical, they cannot be replaced with each other, and more spare parts than actually needed may be stocked. Therefore, a need exists in the art for a stacked card connector which features a simpler securing structure and lower cost and can be secured to any location on the circuit board.

SUMMARY

An object of the present invention is to provide a stacked card-edge connector for fixing and/or holding and electrically connecting at least one electronic card using a card latching device and stackable configuration.

The stacked card-edge connector includes two stackable and interchangeable insulating housings, a pair of first card latches, a pair of second card latches, a pair of fasteners. The pair of first card latches are mounted respectively at the two sides of one insulating housing for fixing and/or holding the at least one electronic card. The pair of second card latches are secured respectively at the two sides of the other insulating housing for fixing and/or holding another electronic card. When two electronic cards are secured respectively by the pair of first and second card latches, disengagement of the electronic card secured by pair of first card latches causes a simultaneous disengagement of the electronic card secured by the pair of second card latches.

BRIEF DESCRIPTION OF THE DRAWINGS

The present invention is illustrated in greater detail below by exemplary embodiments with reference to the attached drawings, in which.

DETAILED DESCRIPTION OF THE EMBODIMENT(S)

Figure 1:
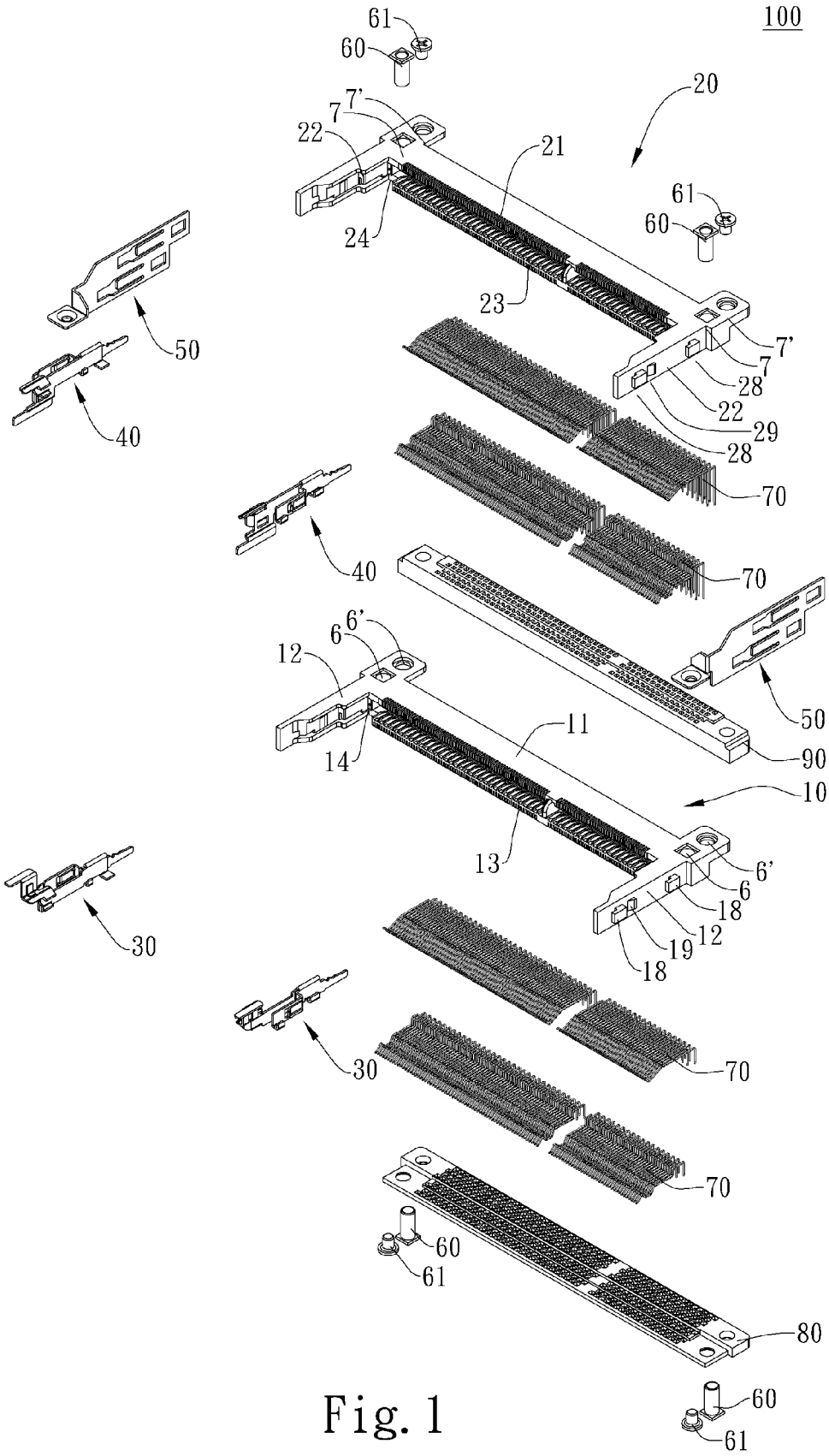
FIG. 1 is an exploded perspective view of a stacked card-edge connector of the present invention.

The invention is explained in greater detail below with reference to the drawings, wherein like reference numerals refer to the like elements. The invention may, however, be embodied in many different forms and should not be construed as being limited to the embodiments set forth herein; rather, these embodiments are provided so that the description will be thorough and complete, and will fully convey the concept of the invention to those skilled in the art.

As shown in FIG. 1, a stacked card-edge connector 100 for fixing and electrically connecting two electronic cards (i.e. the interchangeable first electronic card 1 and second electronic card 2, see FIGS. 6A-6G) to a circuit board 3 (see FIGS. 8A and 8B) is shown. The stacked card-edge connector 100 includes a connector set having two identical, stackable and interchangeable insulating housings (which will hereinafter be referred to as the first insulating housing 10 and the second insulating housing 20 to explicitly indicate their connection with other components), a plurality sets of conductive terminals 70, a first spacer 80 and a second spacer 90; a pair of first card latches 30 positioned respectively at the two sides of the first insulating housing 10 for fixing and/or holding the first electronic card 1 (see FIGS. 6A-6G); a pair of second card latches 40 positioned respectively at the two sides of the second insulating housing 20 for fixing and/or holding the second electronic card 2 (see FIGS. 6A-6G); and a pair of fasteners 50 for fastening the first insulating housing 10 and the second insulating housing 20 of the connector set.

Figure 2A:
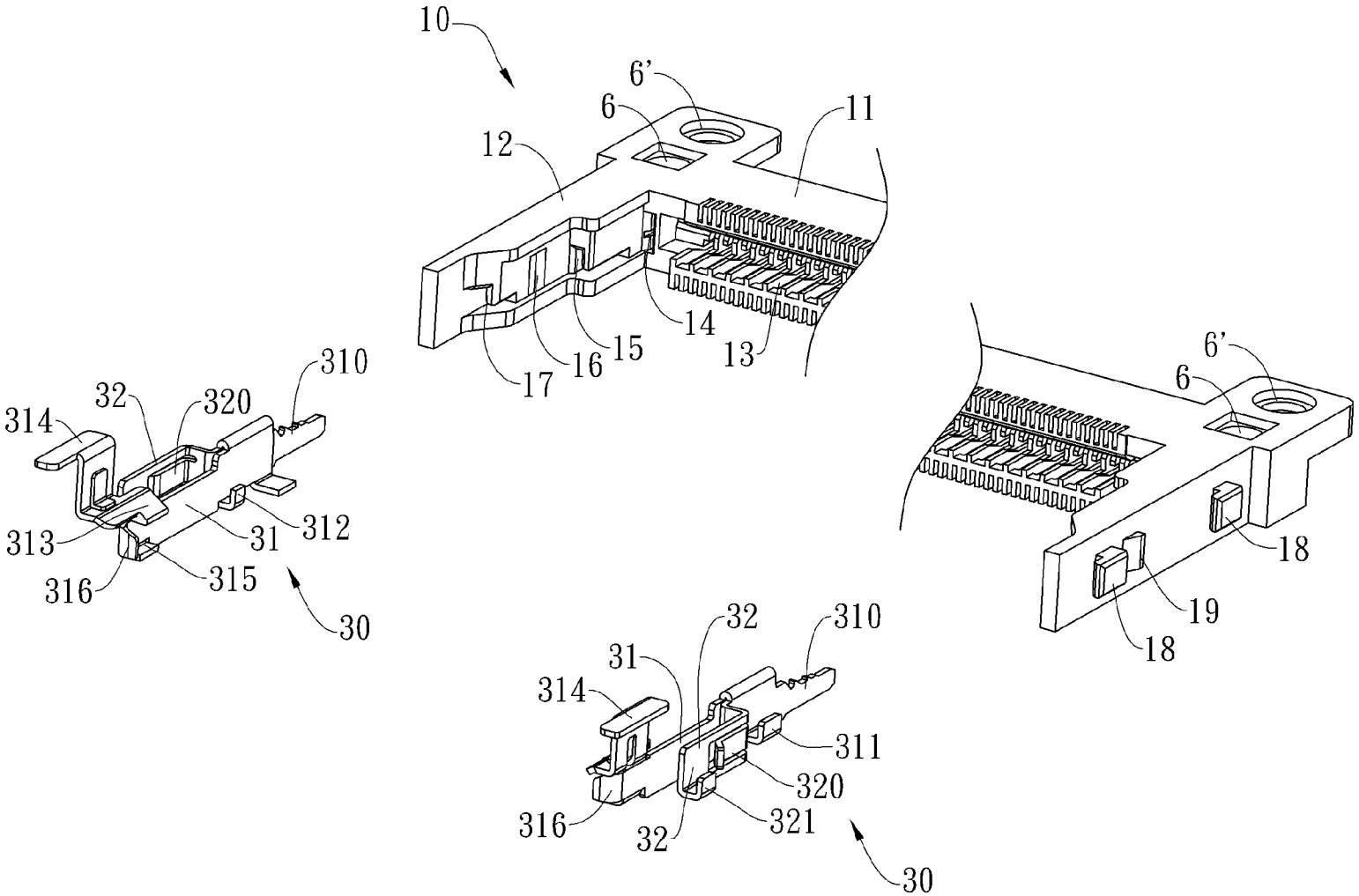
FIG. 2A is a perspective exploded view of a first insulating housing and a pair of first card latch of the stacked card-edge connector of FIG. 1.

Please refer to FIG. 1 and FIG. 2A, a perspective exploded view showing the first insulating housing 10 and the first card latch 30 implemented in the lower level of the stacked card-edge connector 100 shown in FIG. 1. The first insulating housing 10 includes a first support section 11 having two first arms 12 extending, respectively, from the two sides thereof and perpendicular thereto. The front end of the first support section 11 is provided with a first slot 13 whose two sides are each provided with a first hole 14 adjacent to the first arm 12 perpendicular to the support section 11. The first arm 12 is provided with a plurality of first connectors and a plurality of second connectors at the inner and outer side walls thereof respectively, and each of the top and bottom surfaces of the first arm 12 is provided with two lower securing portions 6, 6'. The first slot 13 is provided with a plurality of terminal receiving passageways for receiving the plurality sets of conductive terminals and the first electronic card 1.

In embodiment shown, the plurality of first connectors include a first groove 15 adjacent and perpendicular to the first hole 14, a first oblique recess 16 positioned with the first groove 15 and a first recess 17 positioned with the first oblique recess 16. The plurality of second connectors include a pair of first clasps 18 positioned respectively at the front and rear sides of the outer side wall of the first arm 12 and a first oblique protruding block 19 positioned between the pair of first clasps 18.

Referring to FIG. 1, a plurality sets of conductive terminals 70 are alternately positioned inside and on the bottom surface (not shown) of the first support section 11 of the first insulating housing 10 and the second support section 21 of the second insulating housing 20 respectively, and the first spacer 80 and the second spacer 90 are configured to fix the exposed ends (not shown) of the plurality sets of conductive terminals 70 positioned at the first insulating housing 10 and the second insulating housing 20.

Figure 2B:
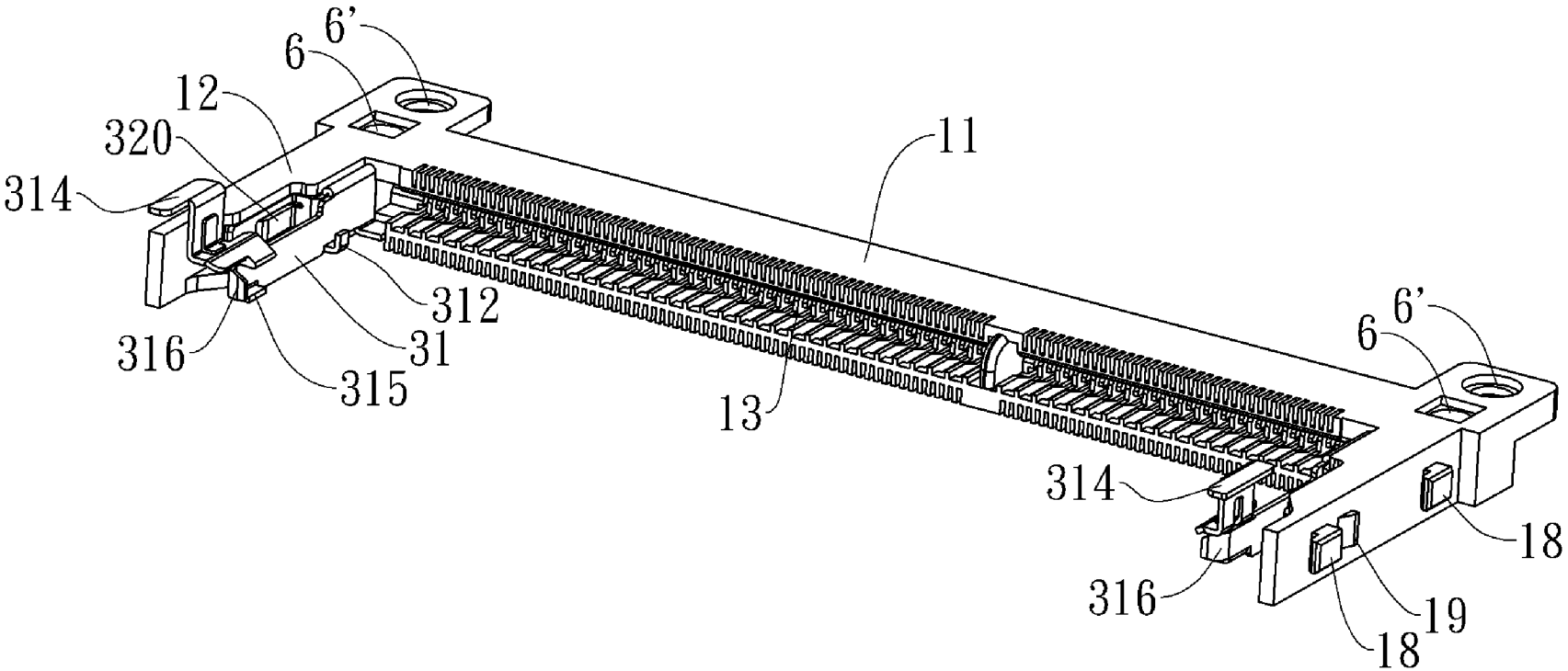
FIG. 2B is a perspective view of the first insulating housing with the pair of first card latches positioned in a lower level of the stacked card-edge connector of FIG. 1.

With reference to FIG. 2A and FIG. 2B, a perspective view showing the combination of the first insulating housing 10 with the pair of first card latches 30 received in the lower level of the stacked card-edge connector 100 shown in FIG. 1. Each of the pair of first card latches 30 includes a first main body 31 from one side of which a first extension 32 branches out, and the front end of the first main body 31 is provided with a first insertion portion 310 for connecting with the first hole 14 of the first support section 11 of the first insulating housing 10 correspondingly. Moreover, the side of the first main body 31 from which the first extension 32 extends is provided with a plurality of third connectors corresponding to the plurality of first connectors of the first arm 12. The shown arrangement enables the first card latch 30 to be positioned in the inner side wall of the first arm 12 of the first insulating housing 10, as shown in FIG. 2B. Furthermore, the other side of the first main body 31 is provided with a first resting portion 312 for supporting the first electronic card 1 (see FIGS. 6F and 6G), and the first main body 31 is provided with a first clutch 313 extending from the upper edge of the rear end thereof and a clasp 316 extending from the rear end thereof for engaging with the cavity 4 of the first electronic card 1 (see FIGS. 6F and 6G) correspondingly. In addition, a first pressing portion 314 extends upwardly from the first clutch 313 and a first horizontal support 315 extends beneath the first clutch 313. The first clutch 313 and the first horizontal support 315 are configured to clutch the first electronic card 1 (see FIGS. 6F and 6G).

In the embodiment shown, the plurality of third connectors include a first front clasp 311 positioned at one side (the same side where the first extension 32 extends) of the first main body 31 and engaging with the first groove 15 correspondingly, a first resilient holding piece 320 positioned on the first extension 32 and engaging with the first oblique recess 16 correspondingly, and a first rear clasp 321 positioned at one side of the first extension 32 and engaging with the first recess 17 correspondingly. The shown arrangement enables the first card latch 30 to be placed in the inner side wall of the first arm 12 of the first insulating housing 10, as shown in FIG. 2B.

Figure 3A:
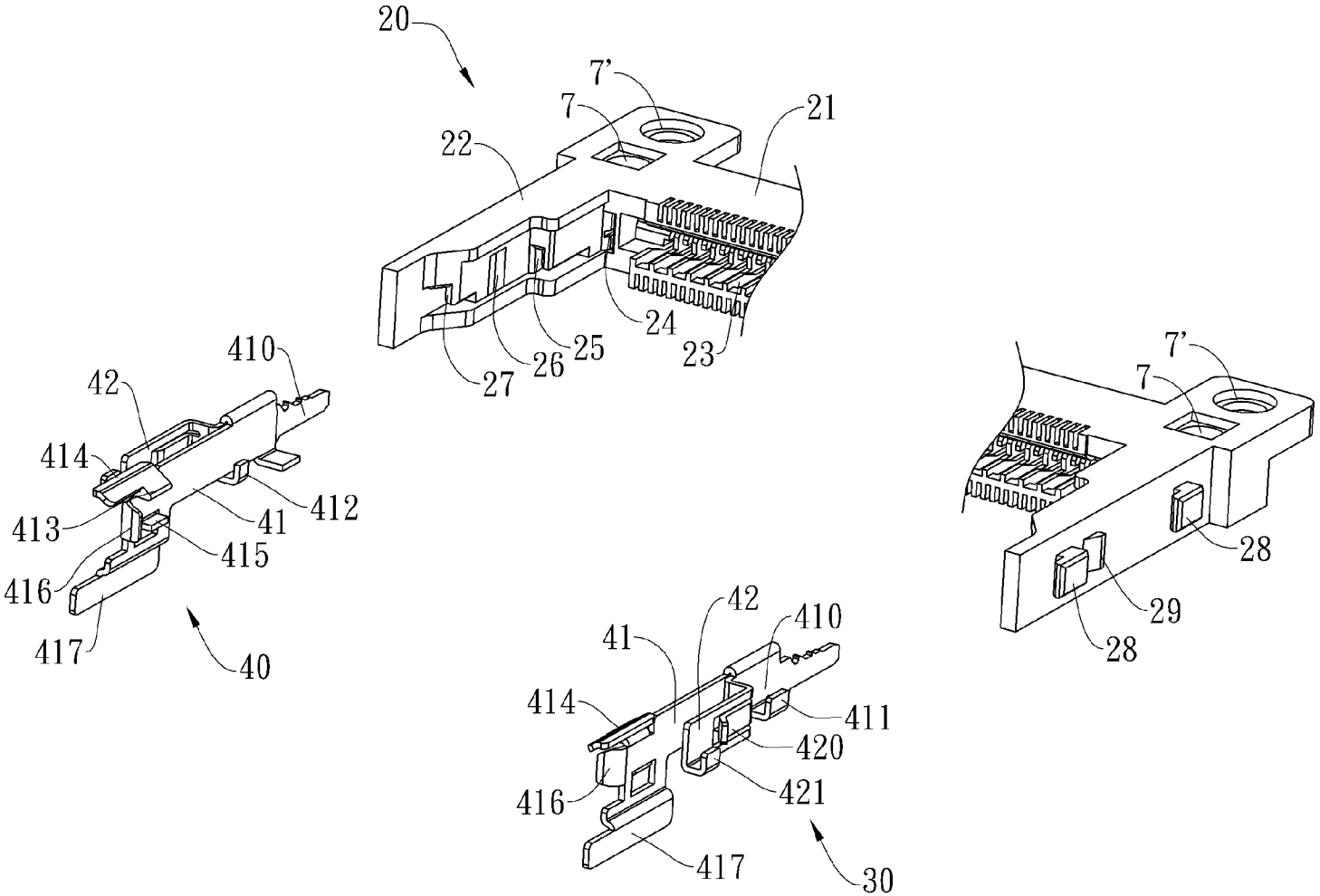
FIG. 3A is a perspective exploded view of a second insulating housing and a second card latch implemented in a upper level of the stacked card-edge connector of FIG. 1.

FIG. 3A is a perspective exploded view showing the second insulating housing 20 and the second card latch 40 received in the upper level of the stacked card-edge connector illustrated in FIG. 1. The second insulating housing 20 includes a second support section 21 having two second arms 22 extending, respectively, from the two sides thereof and perpendicular thereto. The front end of the second support section 21 is provided with a second slot 23 whose both sides are each provided with a second hole 24 adjacent to the second arm 22 perpendicular to the second support section 21. The second arm 22 is provided with a plurality of first connectors and a plurality of second connectors at the inner and outer side walls thereof respectively, and each of the top and bottom surfaces of the second arm 22 is provided with two upper securing portions 7, 7'. The second slot 23 is provided with a plurality of terminal receiving passageways for receiving the plurality sets of conductive terminals and the second electronic card 2.

In the embodiment shown, the plurality of first connectors include a second groove 25 adjacent and perpendicular to the second hole 24, a second oblique recess 26 positioned by the second groove 25 and a second recess 27 positioned by the second oblique recess 26. The plurality of second connectors include a pair of second clasps 28 positioned respectively at the front and rear sides of the outer side wall of the second arm 22 and a second oblique protruding block 29 positioned between the pair of second clasps 28.

Figure 3B:
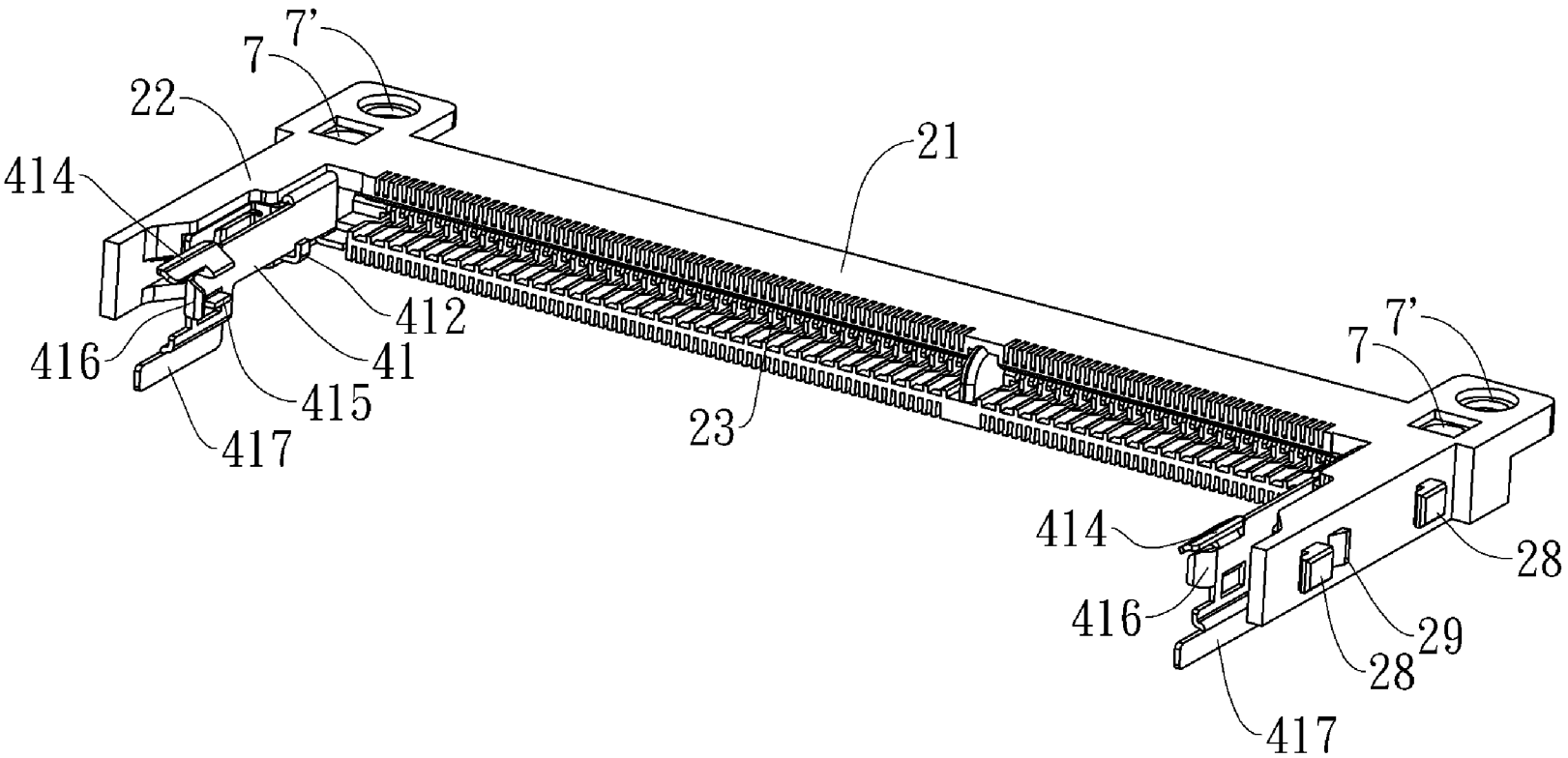
FIG. 3B is a perspective view of the second insulating housing with the pair of second card latches implemented in the upper level of the stacked card-edge connector of FIG. 1.

With reference to FIG. 3A and FIG. 3B, a perspective view showing the combination of the second insulating housing 20 with the pair of second card latches 40 received in the upper level of the stacked card-edge connector 100 shown in FIG. 1. Each of the pair of second card latches 40 has a second main body 41 from one side of which a second extension 42 branches out, and the front end of the second main body 41 is provided with a second insertion portion 410 for connecting with the second hole 24 of the second support section 21 of the second insulating housing 20 correspondingly. Moreover, the side of the second main body 41 from which the second extension 42 extends is provided with a plurality of third connectors corresponding to the first connectors of the second arm 22. The aforementioned arrangement enables the second card latch 40 to be placed in the inner side wall of the second arm 22 of the second insulating housing 20, as shown in FIG. 3B. Furthermore, the other side of the second main body 41 is provided with a second resting portion 412 for supporting the second electronic card 2, and the second main body 41 is provided with a second clutch 413 extending upwardly from the upper edge of the rear end thereof, a linking portion 417 extending downwardly from the lower edge of the rear end thereof and positioned between the first main body 31 and the first extension 32, and a clasp 416 extending from the rear end thereof for engaging with the cavity 5 of the second electronic card 2 (see FIG. 6D) correspondingly. In addition, a second pressing portion 414 extends horizontally from the second clutch 413 and a second horizontal support 415 extends beneath the second clutch 413. The second clutch 413 and the second horizontal support 415 are configured to clutch the second electronic card 2 (see FIG. 6D).

In the embodiment shown, the plurality of third connectors include a second front clasp 411 positioned at one side (the same side where the second extension 42 extends) of the second main body 41 and engaging with the second groove 25 correspondingly, a second resilient holding piece 420 positioned on the second extension 42 and engaging with the second oblique recess 26 correspondingly, and a second rear clasp 421 disposed at one side of the second extension 42 and engaging with the second recess 27 correspondingly. The aforementioned arrangement enables the second card latch 40 to be placed in the inner side wall of the second arm 22 of the second insulating housing 20, as shown in FIG. 3B.

In the embodiment shown, the first groove 15 and the second groove 25 are of an inverted concave shape; the first recess 17, the second recess 27, the first clasp 18 and the second clasp 28 are of an inverted L shape; the first front clasp 311, the second front clasp 411, the first rear clasp 321, the second rear clasp 421, the first resting portion 312 and the second resting portion 412 are of an L shape.

Figure 4:
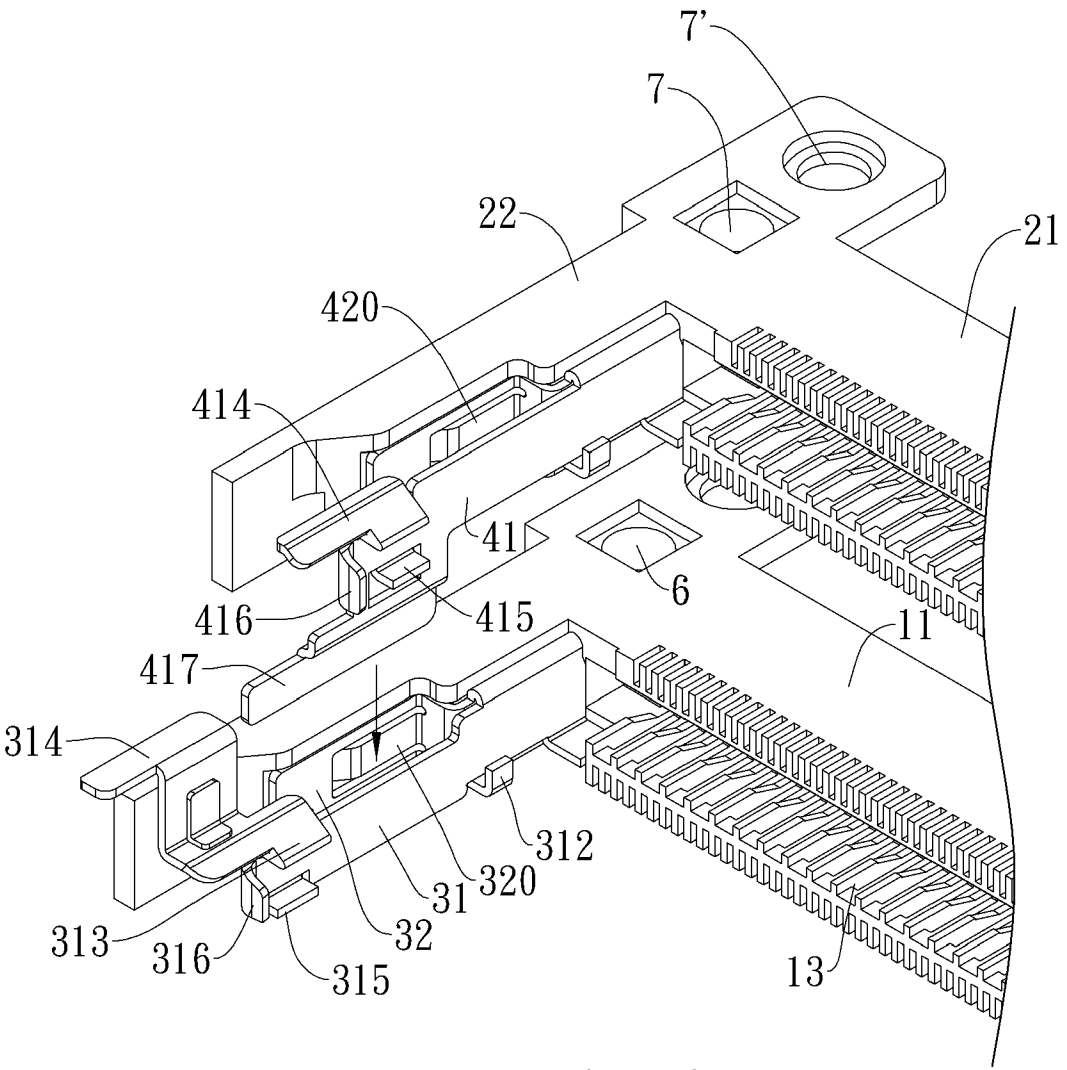
FIG. 4 is an enlarged partial exploded perspective view of the first and second insulating housings combined with the first card latch and the second card latch.

FIG. 4 is an enlarged partial exploded perspective view showing the insulating housings combined with the first card latch and the second card latch. However, the pair of fasteners are omitted. Firstly, the second card latch 40 is placed in the inner side wall of the second arm 22 of the second insulating housing 20 by engaging the second insertion portion 410, the second front clasp 411, the second resilient holding piece 420 and the second rear clasp 421 thereof with the second hole 24, the second groove 25, the second oblique recess 26 and the second recess 27 of the second insulating housing 20 correspondingly. Similarly, the first card latch 30 is positioned in the inner side wall of the first arm 12 of the first insulating housing 10 by engaging the first insertion portion 310, the first front clasp 311, the first resilient holding piece 320 and the first rear clasp 321 thereof with the first hole 14, the first groove 15, the first oblique recess 16 and the first recess 17 of the first insulating housing 10 correspondingly. Next, the second insulating housing 20 combined with the second card latch 40 is stackably mounted on the first insulating housing 10 combined the first card latch 30 so that the linking portion 417 of the second card latch 40 is positioned between the first main body 31 and the first extension 32 and the second slot 23 of the second insulating housing 20 and the first slot 13 of the first insulating housing 10 form a stair-shaped configuration. Finally, the two lower securing portions 6, 6' of the first arm 12 and the two upper securing portions 7, 7' of the second arm 22 receive a securing member to secure the stackably mounted first insulating housing 10 and second insulating housing 20 (see FIG. 1), thereby completing the combination of the first and second insulating housings 10 and 20 with the first and second card latches 30 and 40 respectively, as shown in FIGS. 5A and 5B.

Figure 5A:
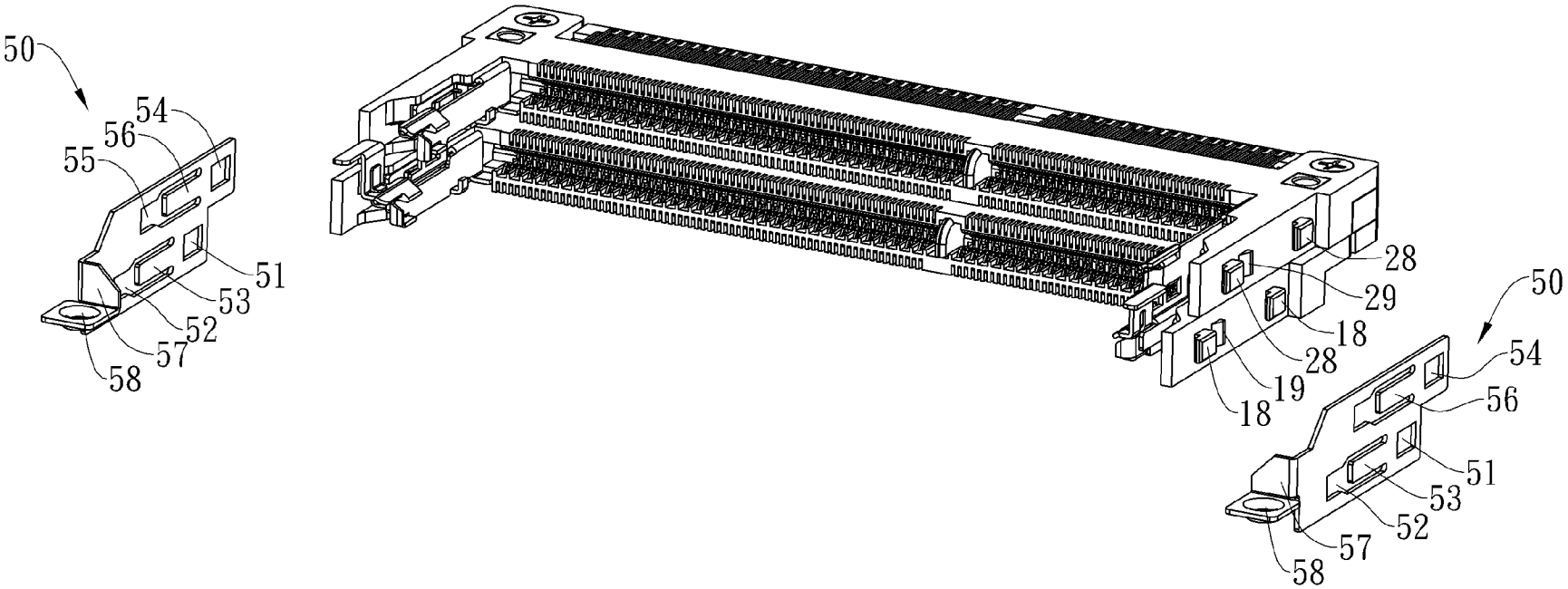
FIG. 5A is a perspective view of the first card latch and the second card latch with the first insulating housing and second insulating housing and a pair of fasteners of the stacked card-edge connector of FIG. 1.
Figure 5B:
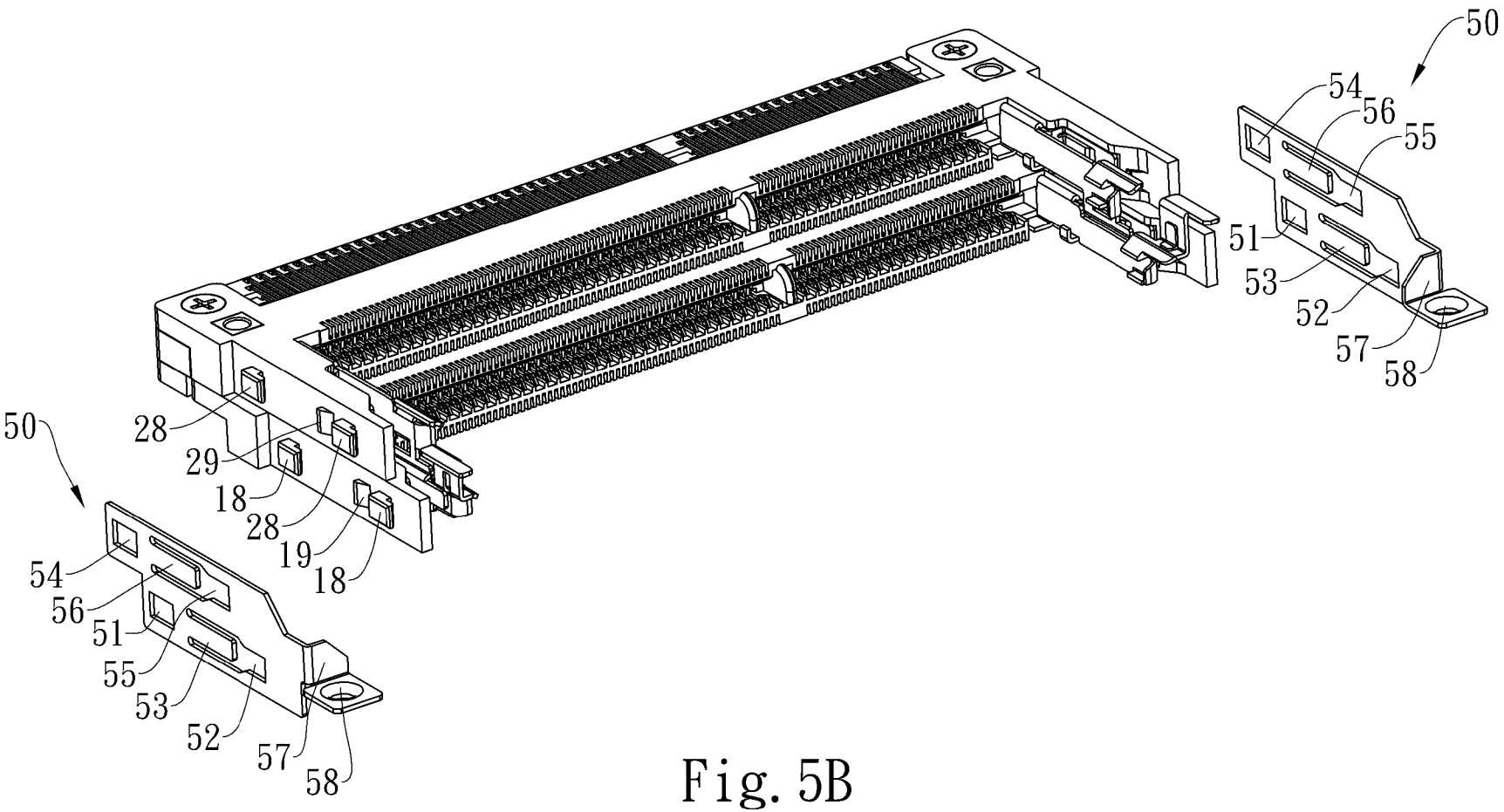
FIG. 5B is another perspective view of the first card latch and the second card latch with the first insulating housing and second insulating housing and the pair of fasteners of the stacked card-edge connector of FIG. 1.
Figure 6A:
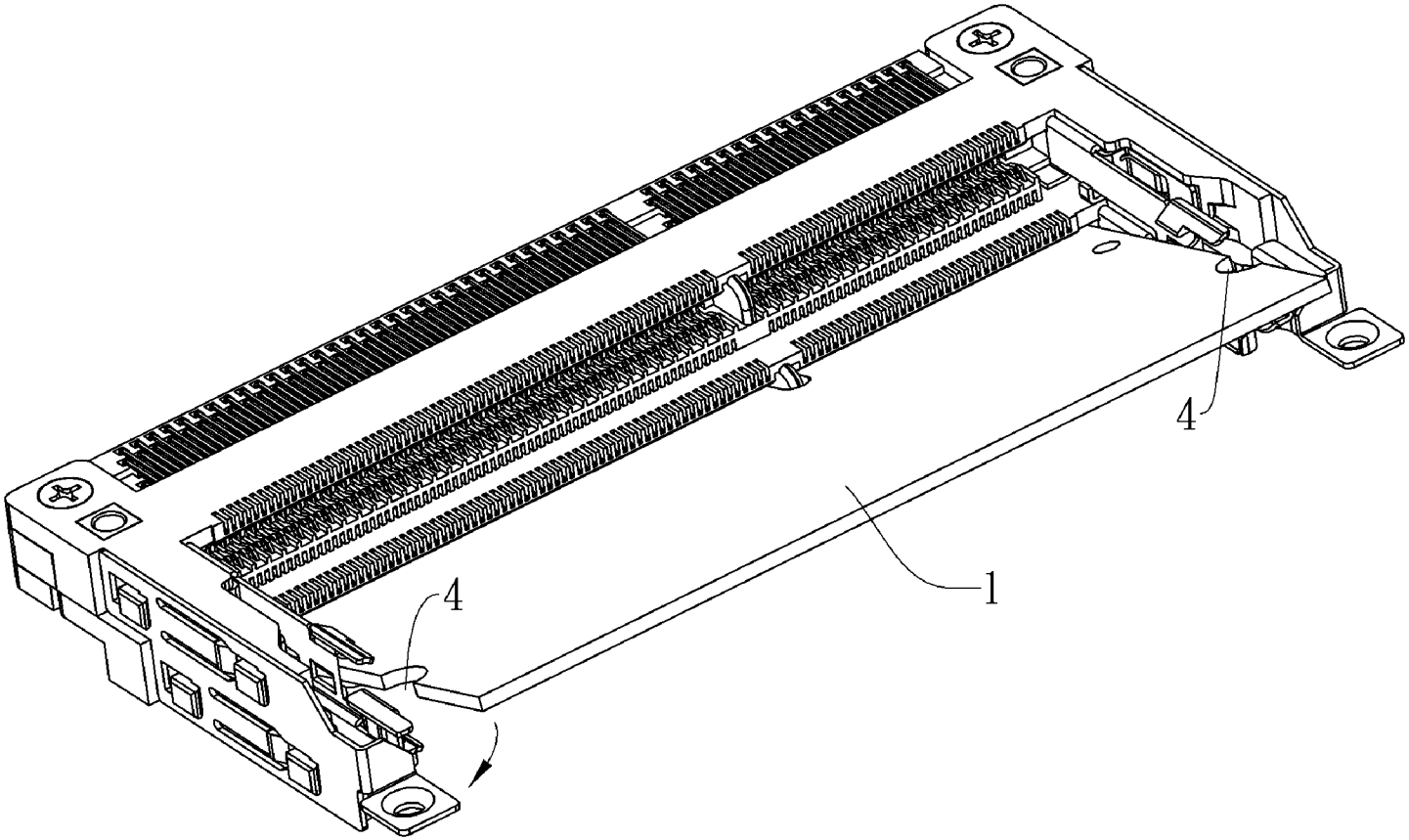
FIGS. 6A-6G are schematic representations showing the stacked card-edge connector of the FIG. 1 with the electronic card(s) inserted therein.
Figure 6B:
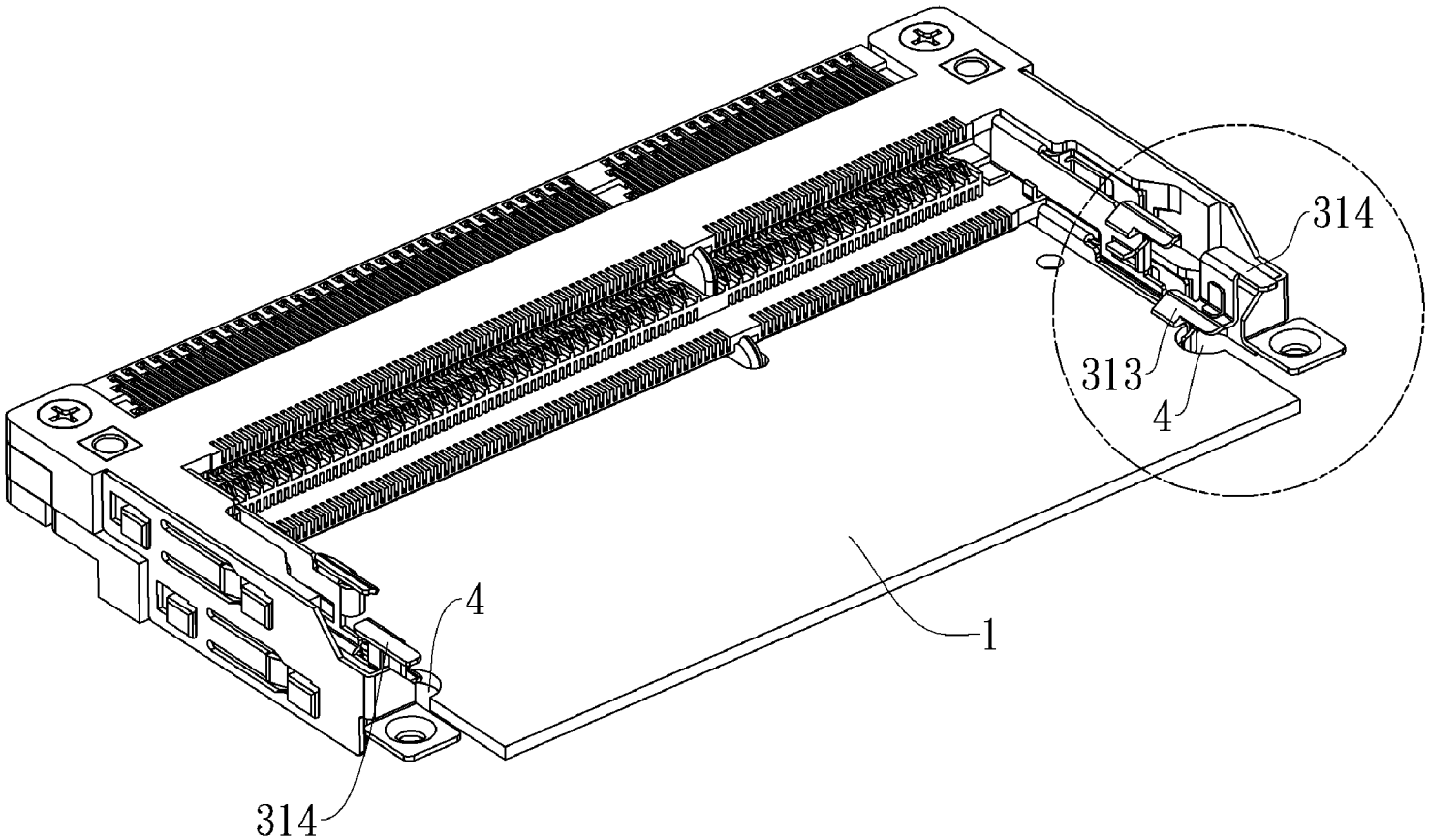
Figure 6C:
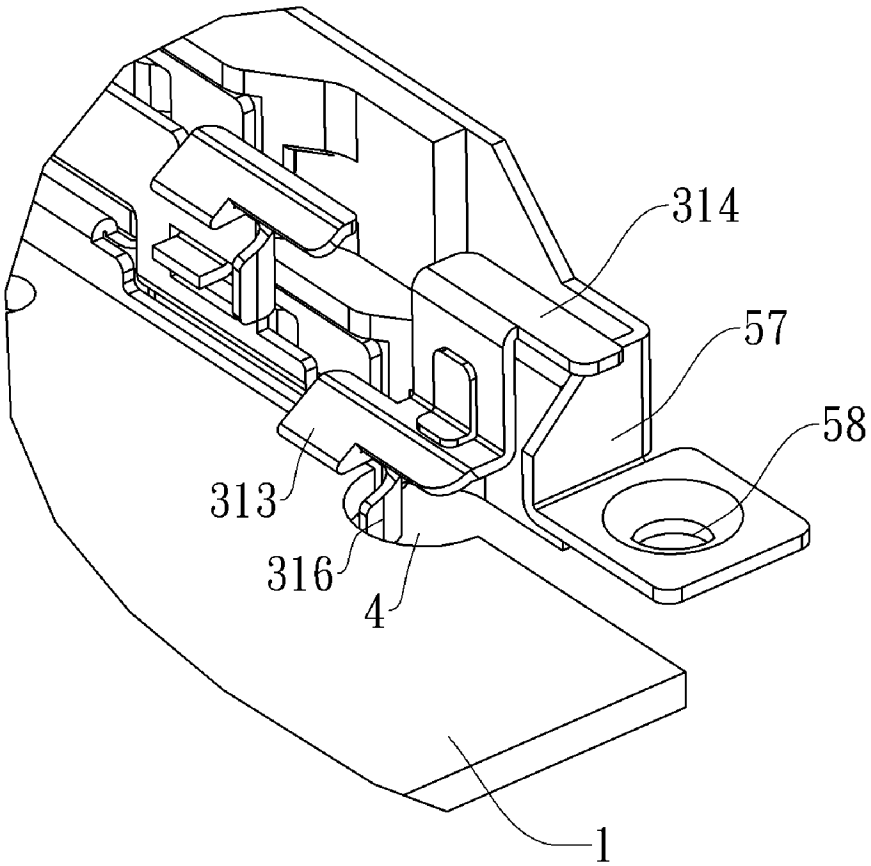
Figure 6D:
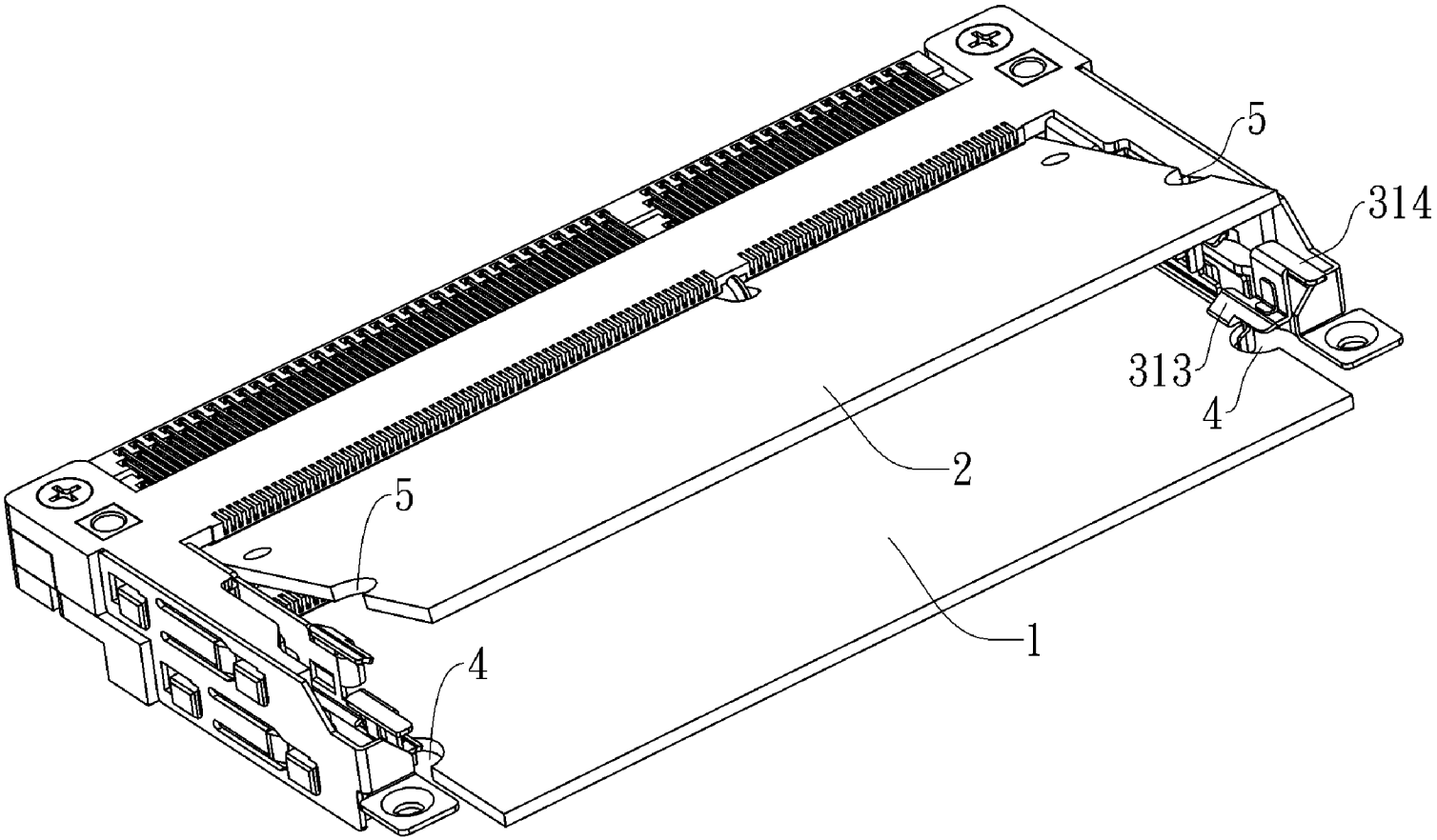
Figure 6E:
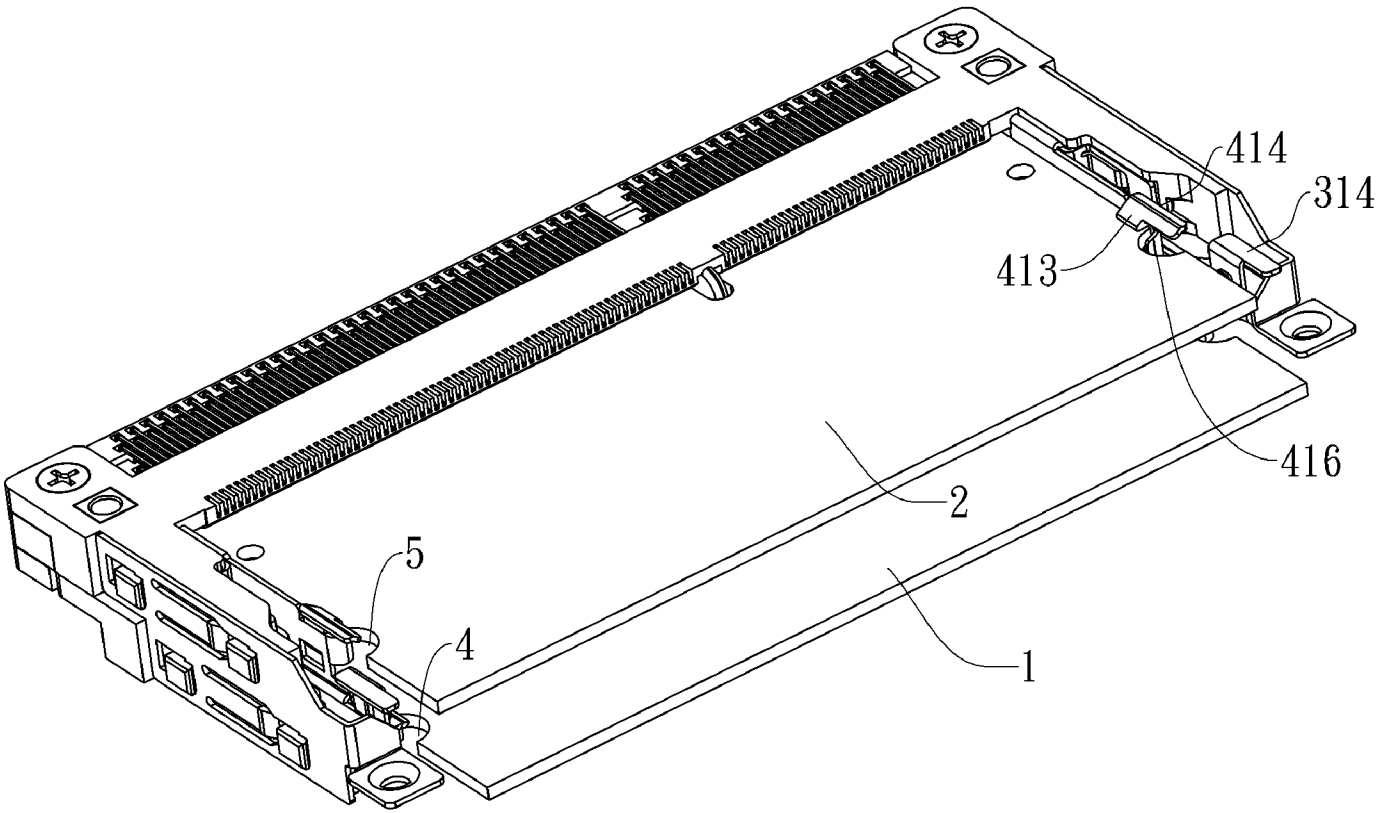
Figure 6F:
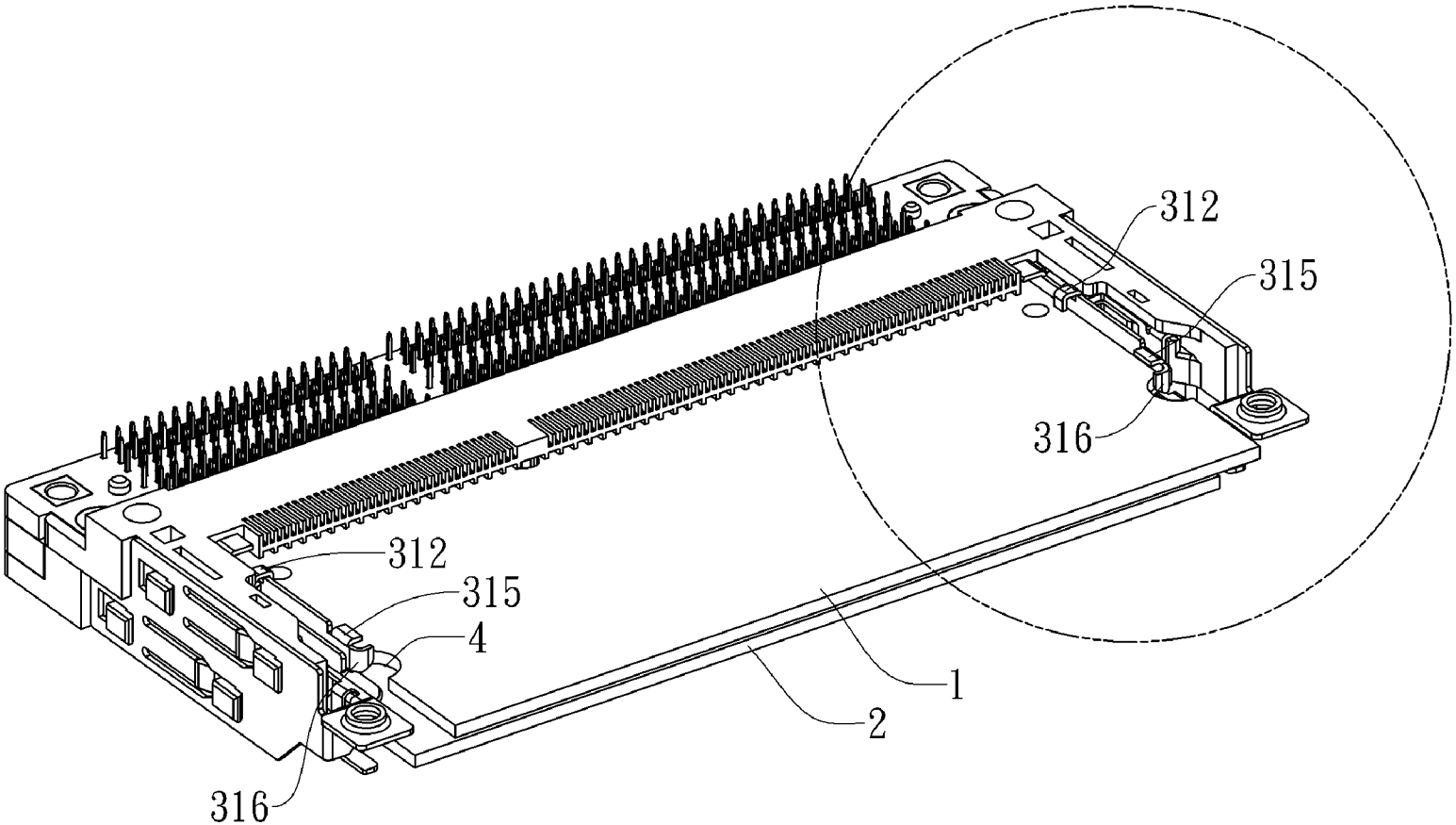
Figure 6G:
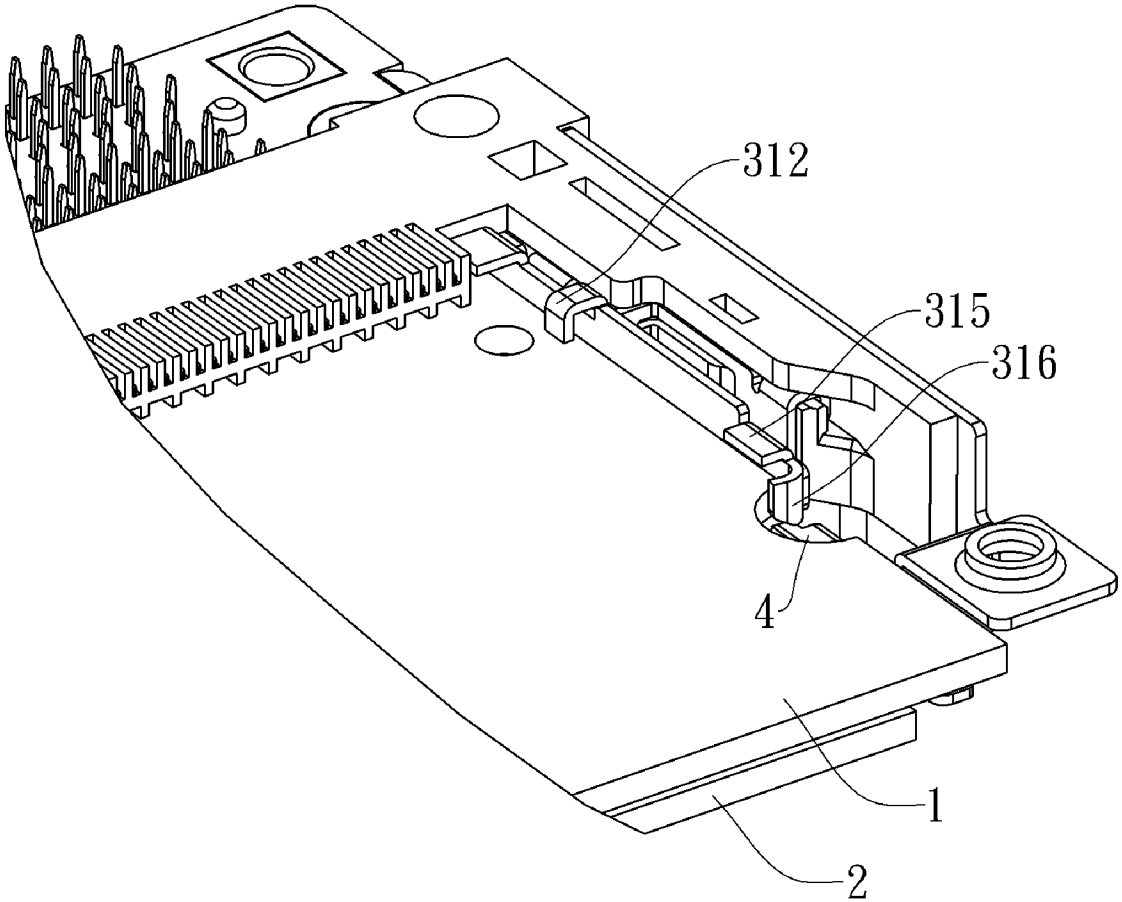

With reference to FIG. 1 and FIGS. 5A and 5B, which are perspective views showing different angles of the first and second card latches mounted on the first and second insulating housings and a pair of fasteners 50 of the stacked card-edge connector 100 shown in FIG. 1. After the first and second insulating housings 10 and 20 have been combined with the first and second card latches 30 and 40 respectively, the pair of fasteners 50 are mounted respectively on the outer side walls of the first and second arms 12 and 22 to fasten the first and second insulating housings 10 and 20. Each of the pair of fasteners 50 is provided with a plurality of fourth connectors corresponding to the plurality of second connectors of the first arm 12. Each of the pair of fasteners 50 is provided with a bent portion lnposelstart57lnposelend extending from the front end thereof and perpendicular to the first and second arms 12 and 22. Moreover, a locking portion 58 extends forwardly from and is perpendicular to the bent portion 57. The locking portion 58 is configured to lock the stacked card-edge connector 100 according to the invention to a circuit board 3 (see FIGS. 8A and 8B).

In the embodiment shown, the fastener 50 is made of metallic material so that the overall structure can be strengthened to improve the conventional plastic fastening structure extending from the insulating housings and to facilitate the interchangeability between the first and second insulating housings 10 and 20 to reduce the cost incurred by using different molds. Moreover, the plurality of fourth connectors in the shown embodiment include a first engaging portion 51, a second engaging portion 52, a first resilient catch section 53 extending from the second engaging portion 52, a third engaging portion 54, a fourth engaging portion 55 and a second resilient catch section 56 extending from the fourth engaging portion 55, wherein the first engaging portion 51 and the second engaging portion 52 engage with the pair of first clasps 18 positioned at the outer side wall of the first arm 12 and the first resilient catch section 53 is resisted by the first oblique protruding block 19 positioned between the pair of first clasps 18 correspondingly while the third engaging portion 54 and the fourth engaging portion 55 engage with the pair of second clasps 28 positioned at the outer side wall of the second arm 22 and the second resilient catch section 56 is resisted by the second oblique protruding block 29 positioned between the pair of second clasps 28 correspondingly. The first engaging portion 51, the second engaging portion 52, the third engaging portion 54 and the fourth engaging portion 55 are engraved holes. To fasten the connector set, the first engaging portion 51 and the second engaging portion 52 of the fastener 50 receive the pair of first clasps 18 of the first insulating housing 10 correspondingly, and the third engaging portion 54 and the fourth engaging portion 55 receive the pair of second clasps 28 of the second insulating housing 20 correspondingly, so that the first resilient catch section 53 is positioned on the first oblique protruding block 19 and the second resilient catch section 56 is positioned on the second oblique protruding block 29. Next, the pair of fasteners 50 are positioned toward the first support section 11 and the second support section 21, causing the first engaging portion 51 and the second engaging portion 52 to receive the pair of first clasps 18 correspondingly, the third engaging portion 54 and the fourth engaging portion 55 to receive the pair of second clasps 28 correspondingly, the first resilient catch section 53 to be resisted by the first oblique protruding block 19, and the second resilient catch section 56 to be resisted by the second oblique protruding block 29, thereby completing the assembly of the stacked card-edge connector 100 according to the invention.

In the shown embodiment, the securing member includes a casing 60 and a screw 61. The casing 60 is hollow and provided with threads in the interior so as to mate with the screw 61. FIGS. 6A-6G are schematic representations showing the stacked card-edge connector 100 of the FIG. 1 with the various electronic card(s) inserted therein. The two sides of the first electronic card 1 are each provided with a cavity 4 while the two sides of the second electronic card 2 are each provided with a cavity 5. To insert the first electronic card 1 and the second electronic card 2 to the stacked card-edge connector 100 according to the invention, the first electronic card 1 is firstly obliquely inserted into the first slot 13 and then pushed downwardly to the proper position. Next, the first clutch 313 and the first horizontal support 315 clutch the first electronic card 1, the first resting portion 312 supports the first electronic card 1 (see FIGS. 6F and 6G), and the clasp 316 positioned at the rear end of the first main body 31 of the first card latch 30 engages with the cavity 4, thereby fastening the first electronic card 1 to the first slot 13 of the first insulating housing 10. Similarly, the second electronic card 2 is obliquely inserted into the second slot 23 and then pushed to the proper position. After that, the second clutch 413 and the second horizontal support 415 clutch the second electronic card 2, the second resting portion 412 supports the second electronic card 2 (not shown), and the clasp 416 positioned at the rear end of the second main body 41 of the second card latch 40 engages with the cavity 5, thereby fastening the second electronic card 2 to the second slot 23 of the second insulating housing 20.

Figure 7A:
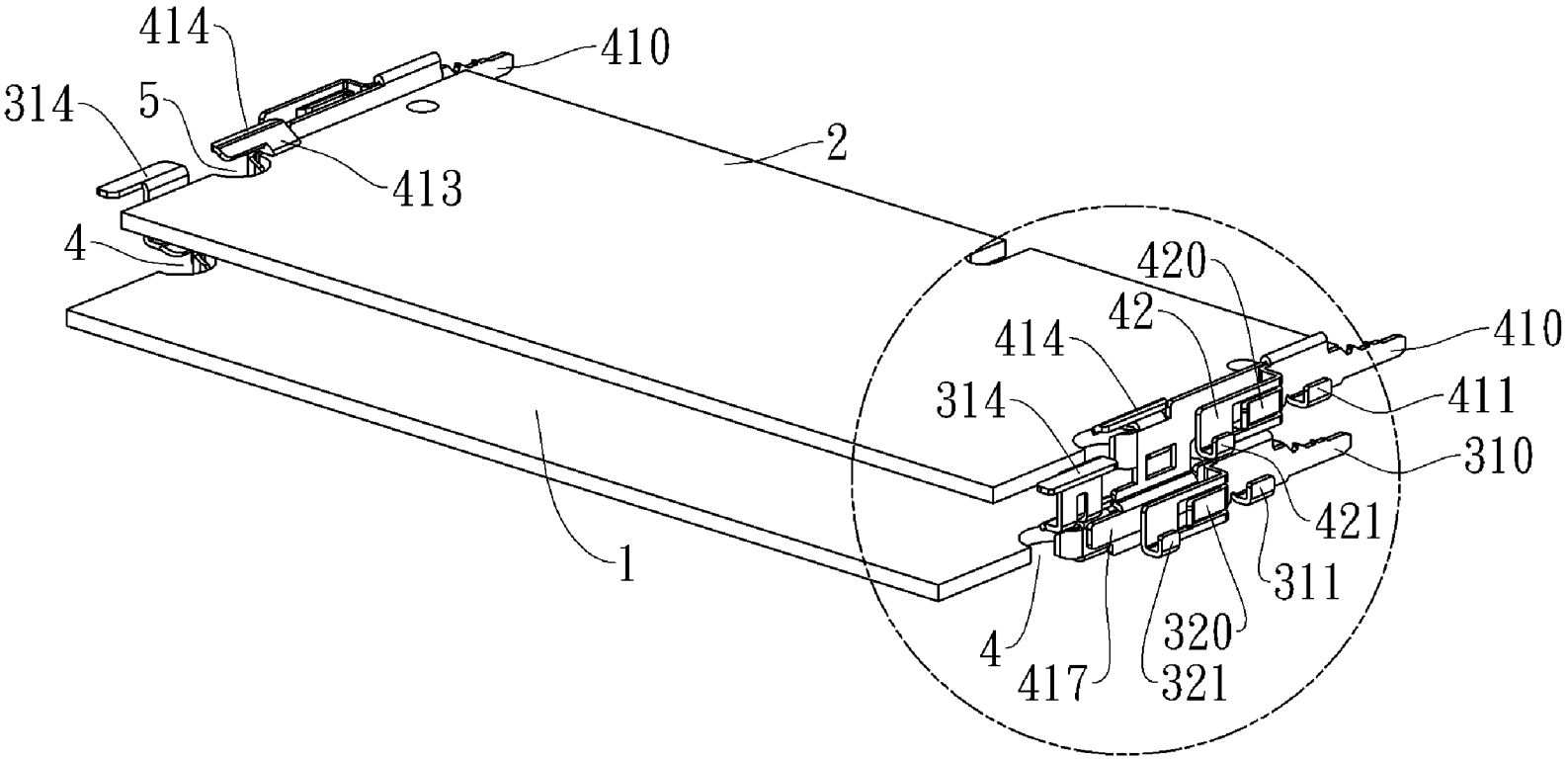
FIG. 7A is a perspective view of two electronic cards secured by a card latching device according to the invention.
Figure 7B:
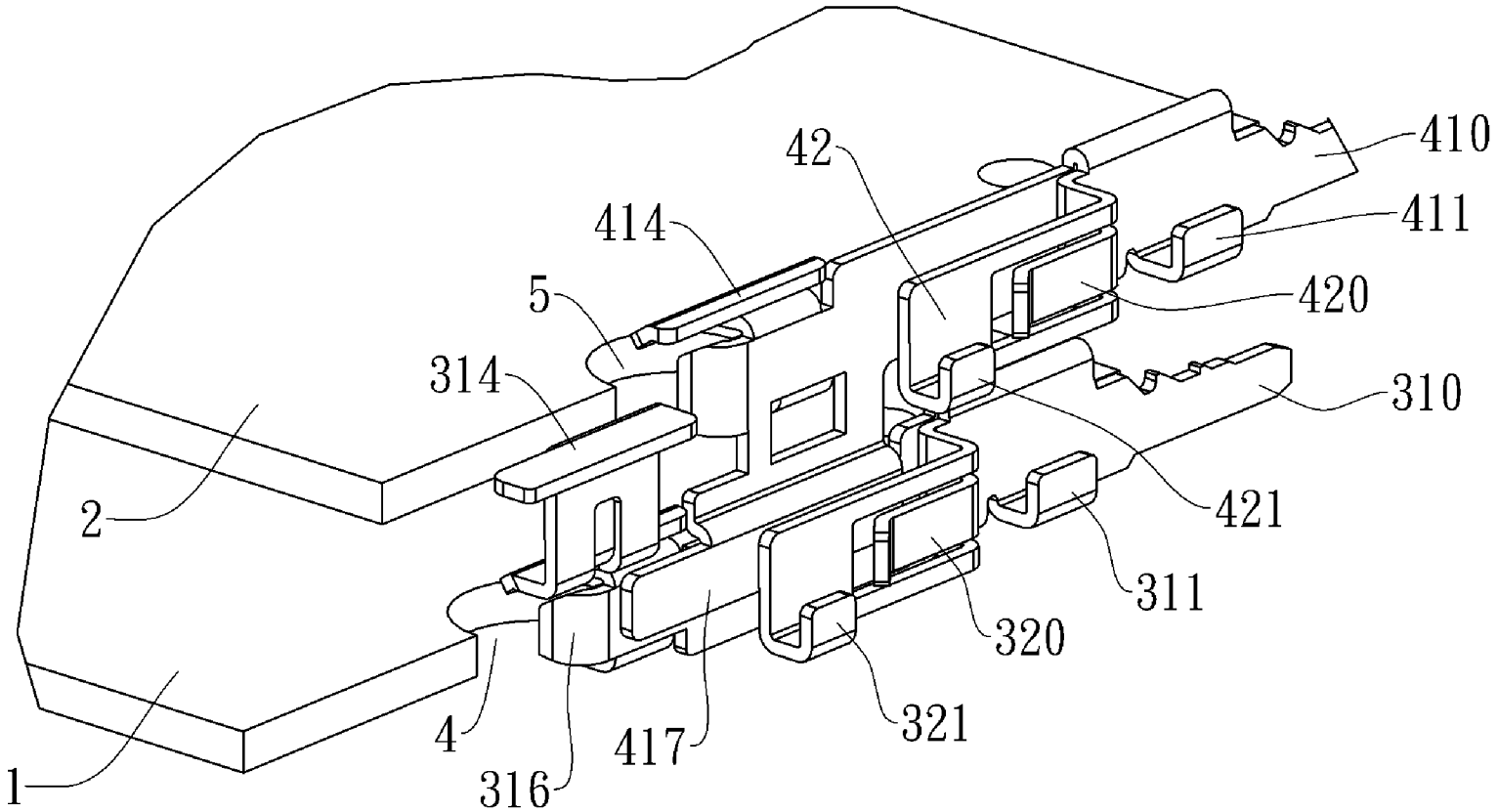
FIG. 7B is an enlarged partial view of two electronic cards secured by the card latching device according to the invention.

With respect to FIGS. 7A and 7B, two electronic cards are shown, being retained by the card latches according to the invention. The drawings merely show the first electronic card, the second electronic card, the first card latch and the second card latch to explicitly illustrate the ejection of the first electronic card and second electronic card from the stacked card-edge connector according to the invention. To eject the second electronic card 2 inserted in the second slot 23 from the stacked card-edge connector 100 according to the invention, the second pressing portion 414 of each of the pair of second card latches 40 is pressed to cause an upward tilt of the second clutch 413, thereby the second electronic card 2 free from the second clutch 413 bounces upwardly and rests obliquely in the second slot 23 for withdrawal. To eject the first electronic card 1 from the card-edge connector 100 according to the invention, the first pressing portion 314 of each of the pair of first card lathing members 30 is pressed to cause an upward tilt of the first clutch 313, thereby the first electronic card 1 free from the first clutch 313 bounces upwardly and rests obliquely in the first slot 13. At the same time, the upward tilt of the first clutch 313 slants the first main body 31 to push the linking portion 417 positioned between the first main body 31 and the first extension 32 and cause an upward tilt of the second clutch 413, thereby the second electronic card 2 free from the second clutch 413 bounces upwardly and rests obliquely in the second slot 23 for withdrawal. Consequently, the ejection of the first electronic card 1 inserted in the first slot 13 from the card-edge connector 100 according to the invention enables the second electronic card 2 inserted in the second slot 23 to be ejected simultaneously.

Figure 8A:
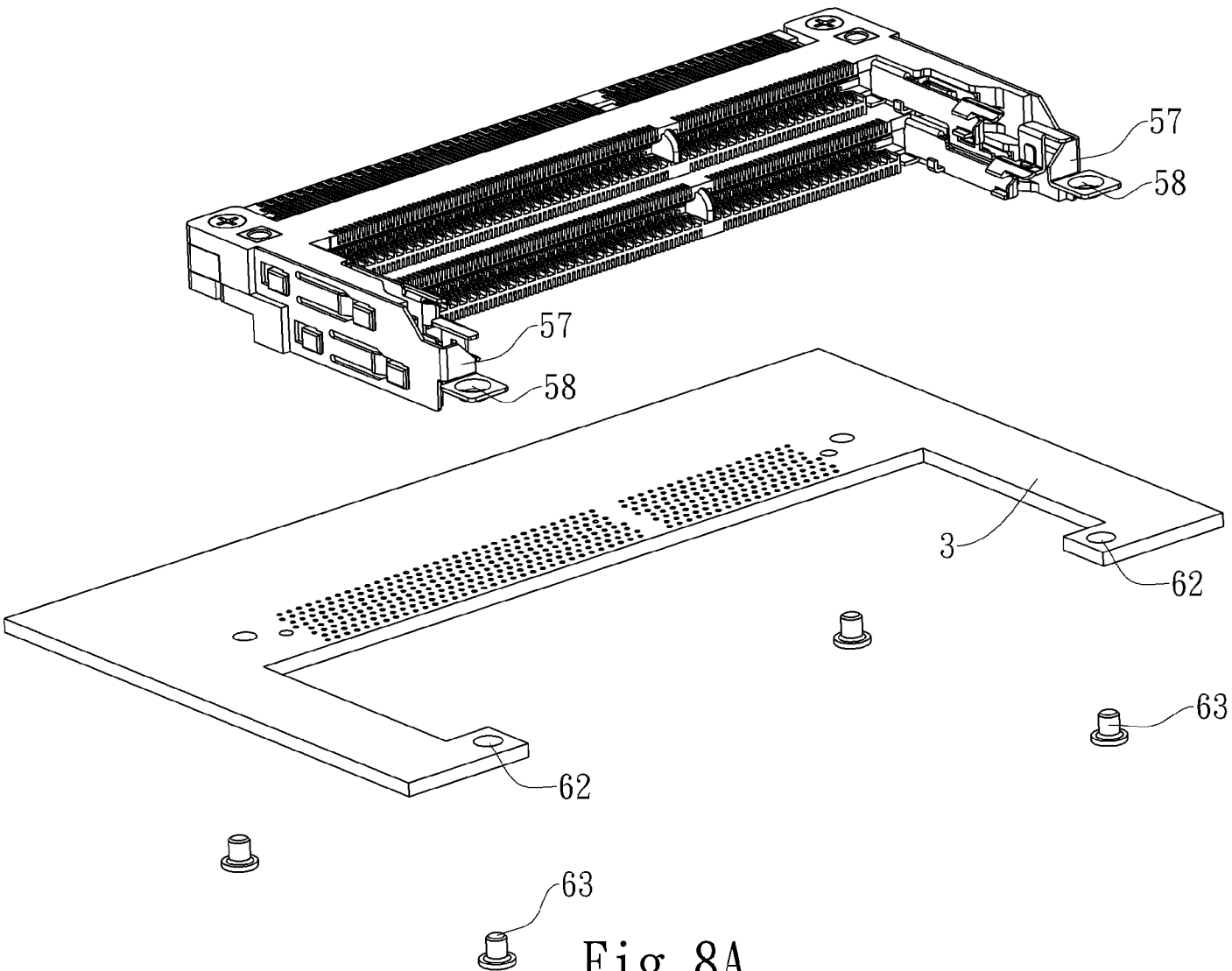
FIG. 8A is an exploded perspective view of a stacked card-edge connector according to the invention and a circuit board.
Figure 8B:
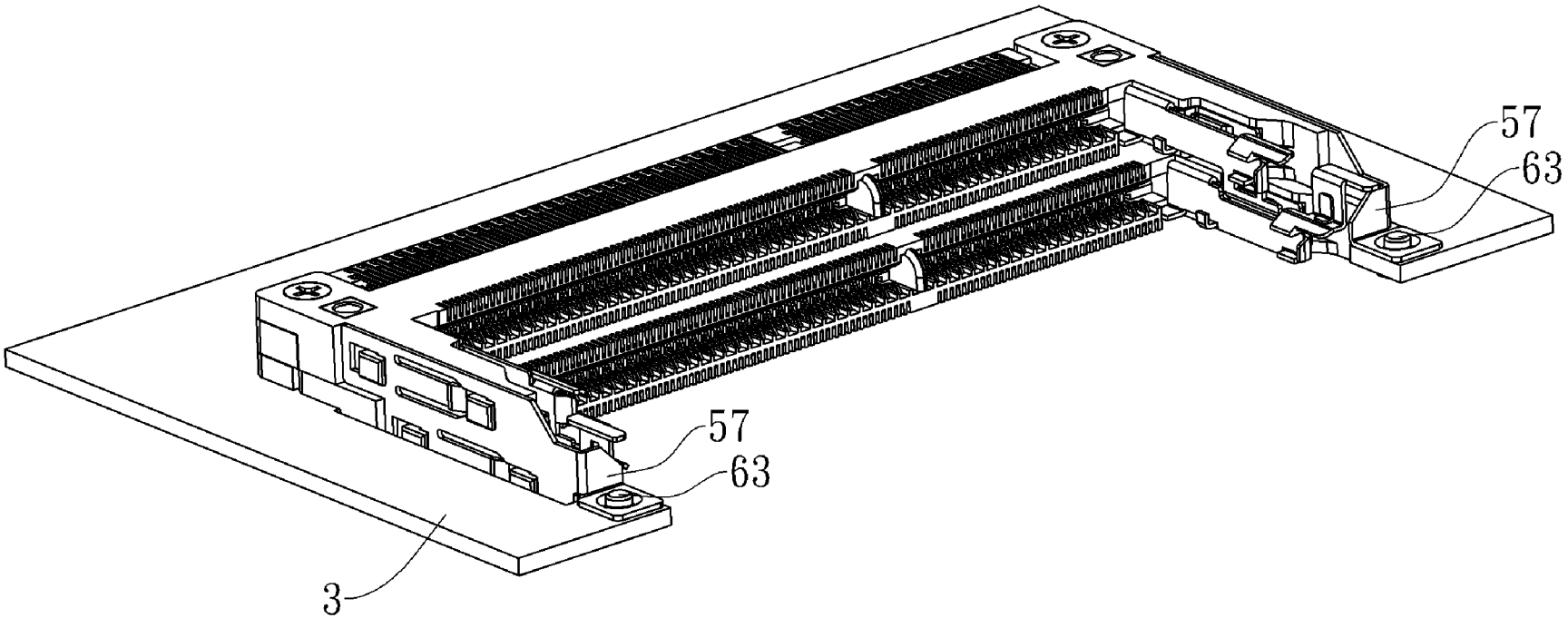
FIG. 8B is a perspective view of a connection between the stacked card-edge connector according to the invention and the circuit board in FIG. 8A.
Figure 8C:
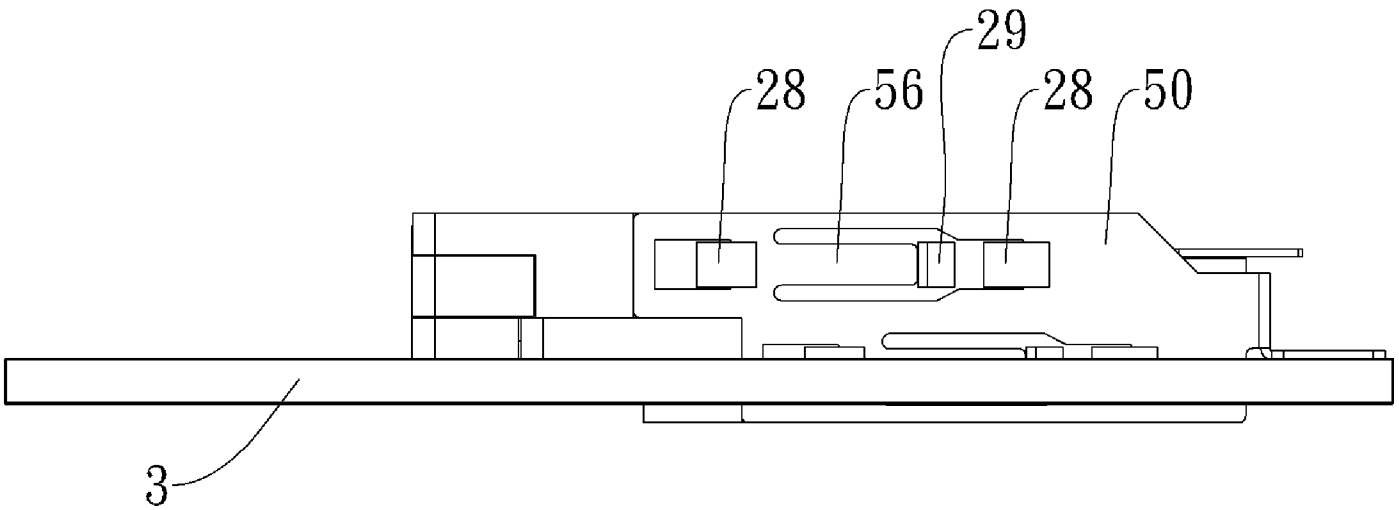
FIG. 8C are side view of the connection shown in FIG. 8B.

With reference to FIGS. 8A-8C, connection between the stacked card-edge connector according to the invention and a circuit board is shown. The two sides of the circuit board 3 are provided with two through holes 62 corresponding to the locking portions 58 of the pair of fasteners 50. Moreover, the stackably mounted first and second insulating housings 10 and 20 form a stair-shaped configuration as shown in FIG. 8C, thus the circuit board 3 to which the stackably mounted first and second insulating housings 10 and 20 are electrically connected is a sinking type circuit board. The stacked card-edge connector 100 according to the invention is secured to the circuit board 3 by fastening the screw 63 of a securing member inserted into the through hole 62 of the circuit board 3.

Figure 9A:
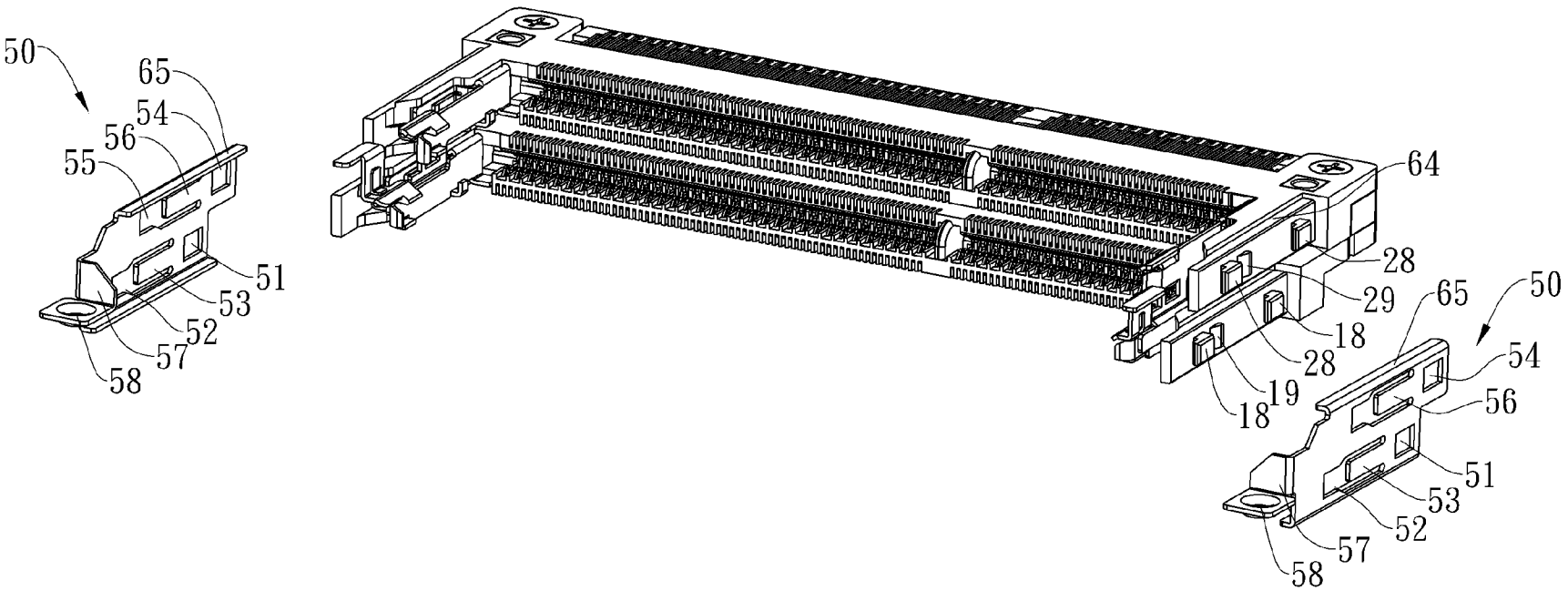
FIG. 9A is an exploded perspective view of another stacked card-edge connector according to the invention.
Figure 9B:
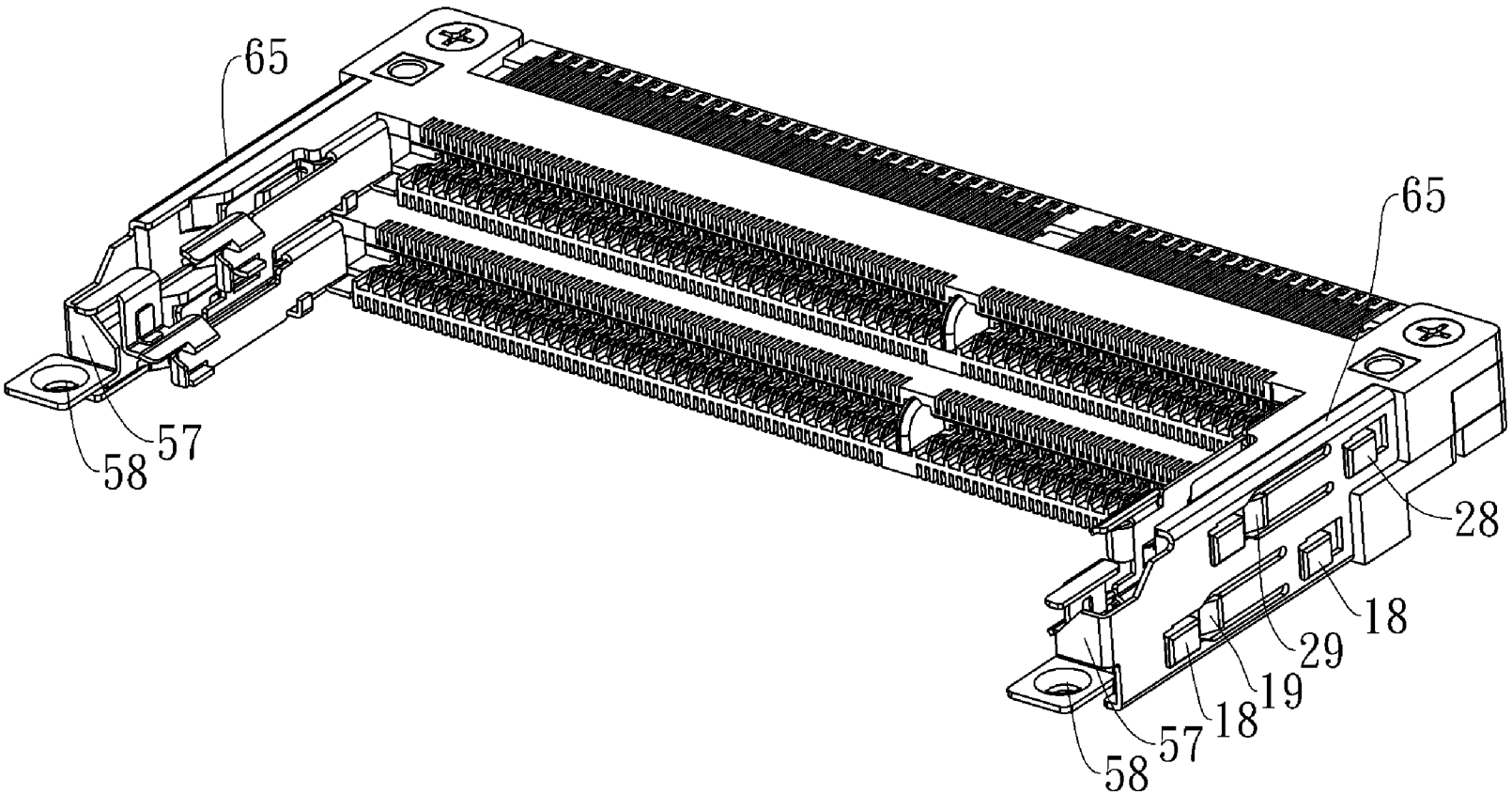
FIG. 9B is an assembly view of another stacked card-edge connector according to the invention.

With reference to FIGS. 9A and 9B, a perspective exploded view and an assembly view showing another stacked card-edge connector according to the invention is shown. This embodiment and the embodiment illustrated in FIGS. 1-8 are substantially the same in terms of structure and operation except that this embodiment is provided with additional reinforcing members to strengthen the structure of the fasteners 50. The upper and lower edges of each of the pair of fasteners 50 are both provided with a bent elongated retaining portion 65 corresponding to the recess 64. The top surface and the outer side of the bottom surface of the first arm 12 are both provided with a recess 64 parallel to the first arm 12, and the top surface and the outer side of the bottom surface of the second arm 22 are both provided with a recess 64 parallel to the second arm 22. Consequently, the fastener 50 can more securely fasten the stackably mounted first and second insulating housings 10 and 20 by engaging the bent elongated retaining portion 65 with the recess 64.

Figure 10A:
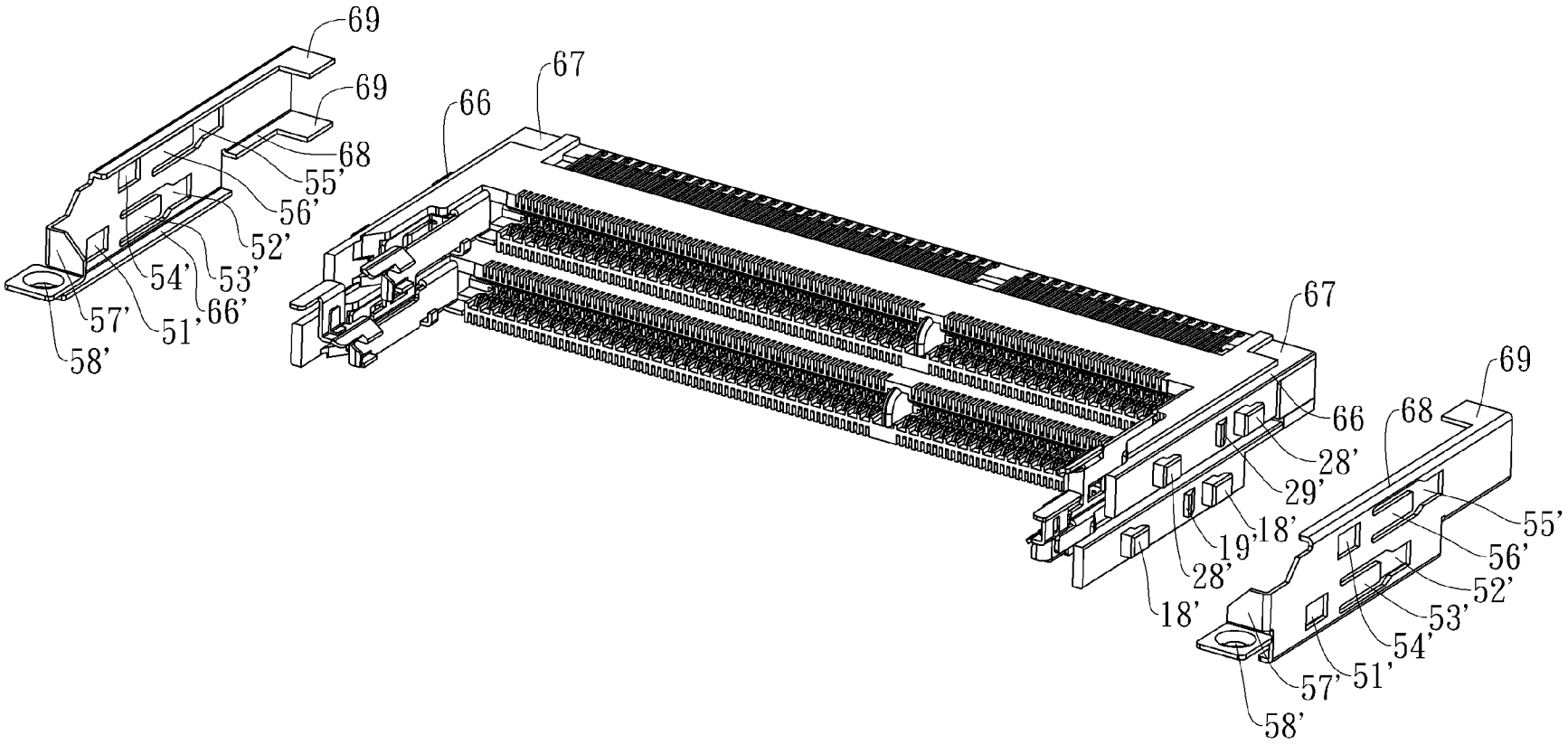
FIG. 10A is a perspective exploded view of another stacked card-edge connector according to the invention.
Figure 10B:
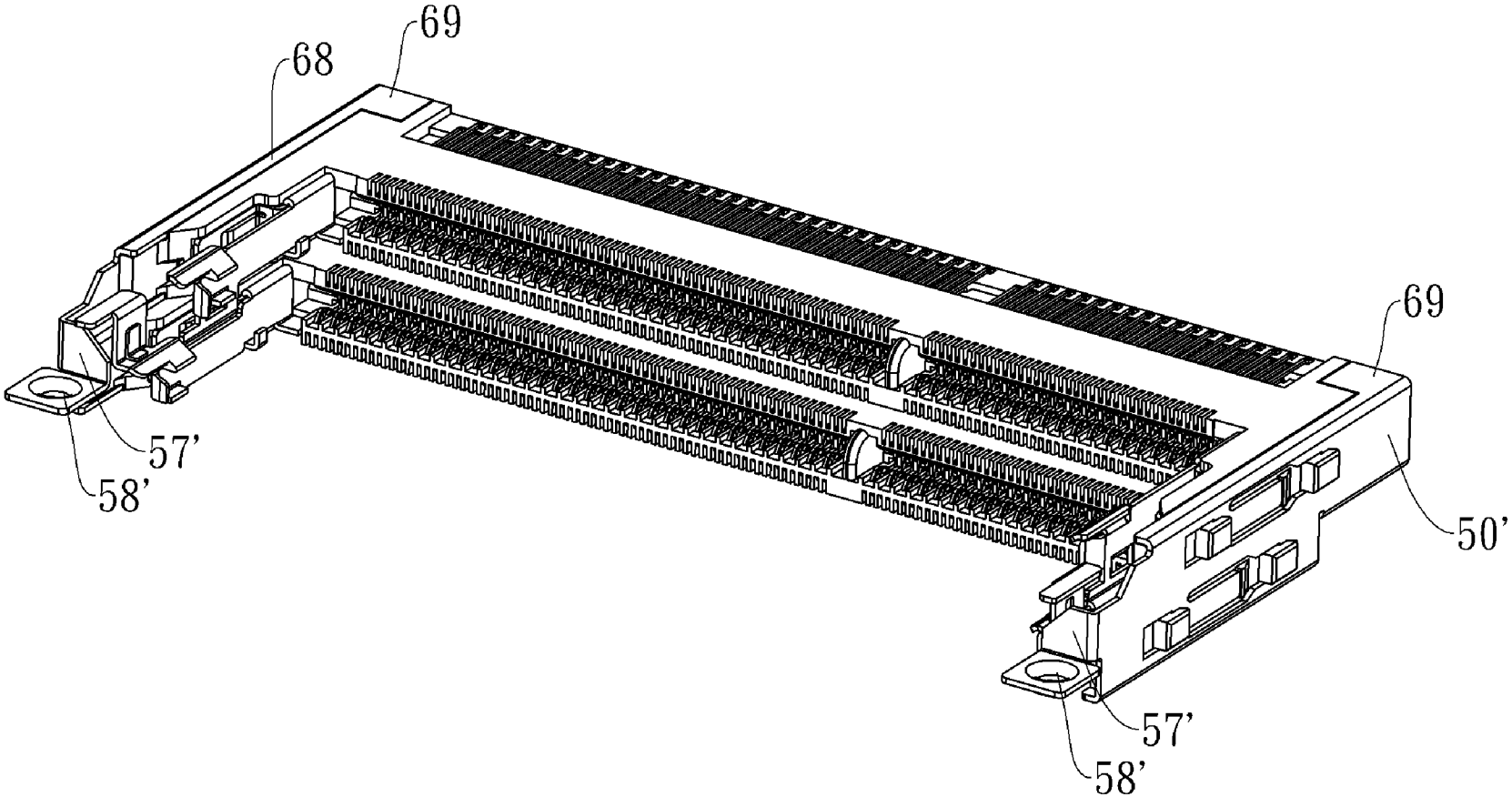
FIG. 10B is an assembly view of another stacked card-edge connector according to the invention.

With reference to FIGS. 10A and 10B, a perspective exploded view and an assembly view showing another stacked card-edge connector according to the invention is shown. This embodiment and the embodiment illustrated in FIGS. 9A and 9B are substantially the same in terms of structure and operation except that each of the top and bottom surfaces of the first arm 12 of this embodiment is not provided with two lower securing portions 6, 6'. Similarly, each of the top and bottom surfaces of the second arm 22 of this embodiment is not provided with two upper securing portions 7, 7'. Consequently, the casing 60 and the screw 61 are not required in the embodiment shown. To strengthen the structure of the fastener 50, the upper and lower edges of the fastener 50 are each provided with a F-shaped reinforcing member having a horizontal retaining portion 68 and a vertical retaining portion 69. Moreover, the top surface and the outer side of the bottom surface of the first arm 12 are each provided with a horizontal recess 66 parallel to the first arm 12 and a vertical recess 67 perpendicular to the first arm 12 respectively, and the top surface and the outer side of the bottom surface of the second arm 22 are each provided with a horizontal recess 66 parallel to the second arm 22 and a vertical recess 67 perpendicular to the second arm 22 respectively. Accordingly, the first clasp 18' and the second clasp 28' of the embodiment shown are of an inverted L shape in a direction opposite to the direction of the first clasp 18 and the second clasp 28 of the embodiment shown in FIGS. 9A and 9B. Similarly, the oblique direction of the first oblique protruding block 19' and the second oblique protruding block 29' of this embodiment are opposite to that of the first oblique protruding block 19 and the second oblique protruding block 29 of the embodiment shown in FIGS. 9A and 9B. Therefore, the locations and direction of the first engaging portion 51', the second engaging portion 52', the first resilient catch section 53', the third engaging portion 54', the fourth engaging portion 55' and the second resilient catch section 56' of the fastener 50 are opposite to the locations and direction of the first engaging portion 51, the second engaging portion 52, the first resilient catch section 53, the third engaging portion 54, the fourth engaging portion 55 and the second resilient catch section 56 of the fastener shown in FIGS. 9A and 9B. Consequently, the fastener 50 can more securely fasten the stackably mounted first and second insulating housings 10 and 20 by engaging the F-shaped horizontal retaining portion 68 and vertical retaining portion 69 with the horizontal recess 66 and the vertical recess 67, respectively.

Figure 11A:
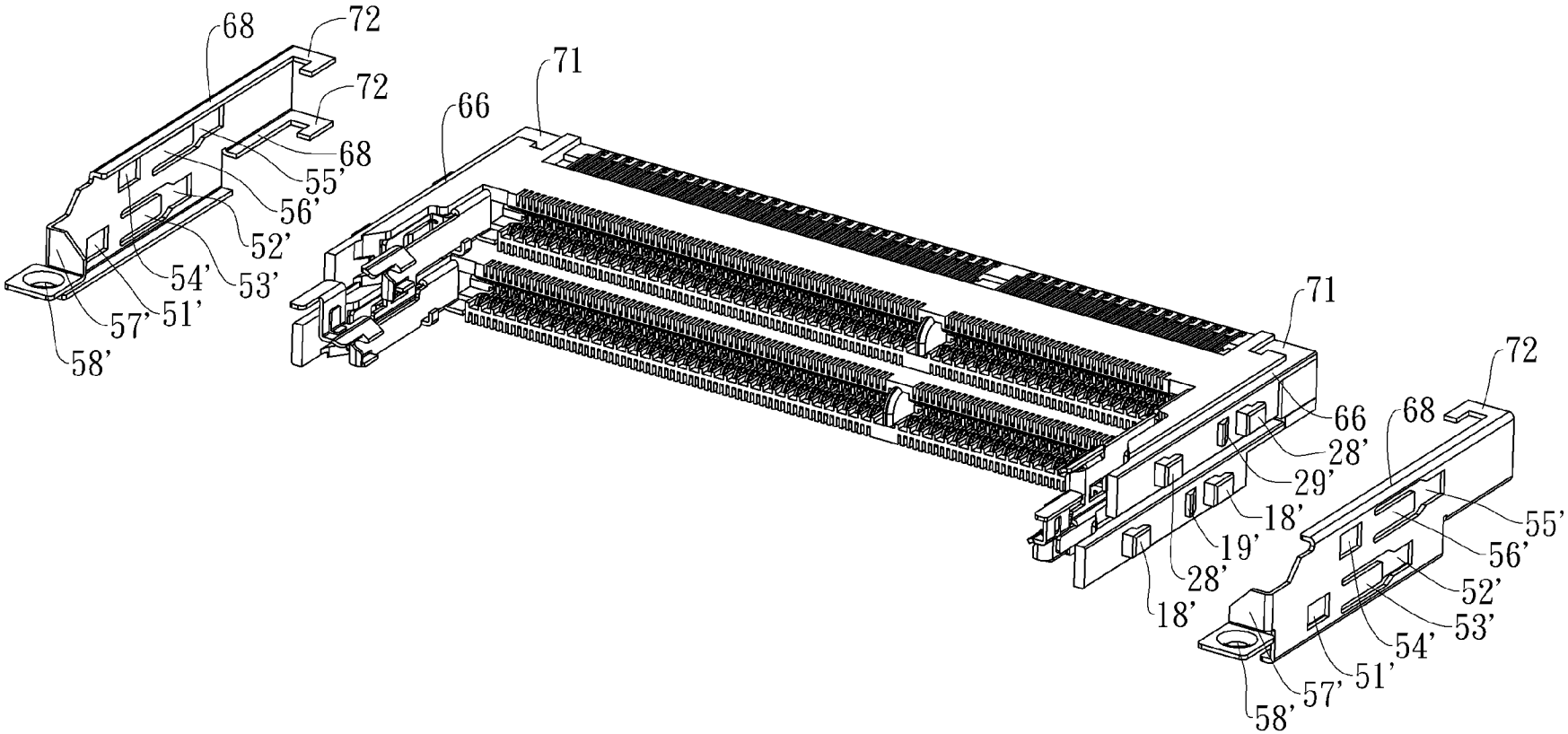
FIG. 11A is a perspective exploded view of another stacked card-edge connector according to the invention.
Figure 11B:
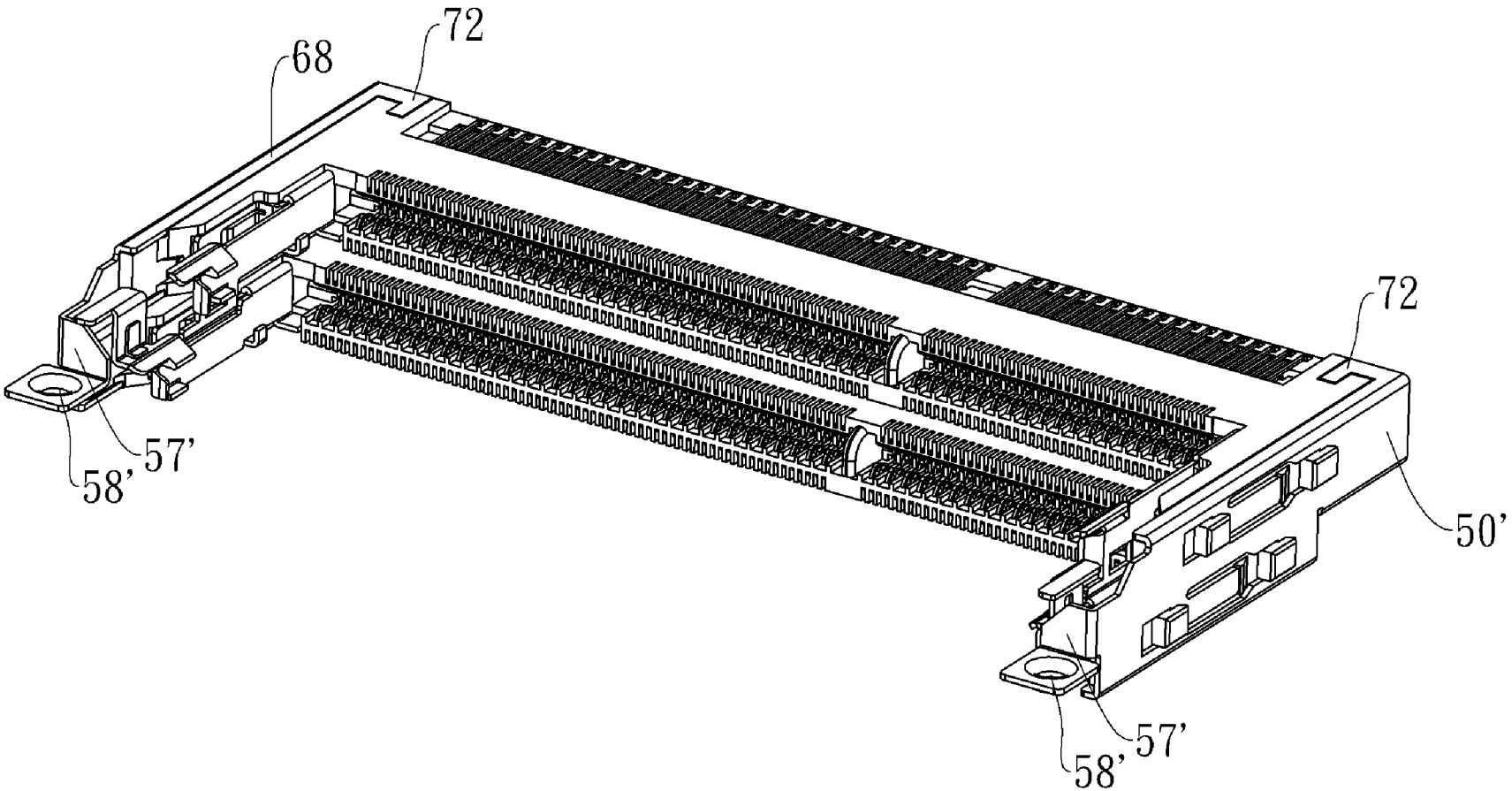
FIG. 11B is an assembly view of another stacked card-edge connector according to the invention.

With reference to FIGS. 11A and 11B, a perspective exploded view and an assembly view showing another stacked card-edge connector according to the invention is shown. This embodiment and the embodiment shown in FIGS. 10A and 10B are substantially the same in terms of structure and operation except that the vertical recess and the vertical retaining portion of the embodiment shown in FIG. 10A are altered to a hook-shaped recess 71 and a hook-shaped retaining portion 72. Such an inverted L-shaped reinforcing member can reinforce the performance of the fastener 50 even further.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A stacked card-edge connector for fixing and electrically connecting at least one electronic card to a circuit board comprising:

a connector set having a first insulating housing and a second insulating housing stackably mounted with the first insulating housing, the first insulating housing and the second insulating housing having a support section, an arm extending vertically from each of two sides of the support section, a plurality of first connectors and a plurality of second connectors positioned respectively at an inner side and an outer side of the arm;

a pair of first card latches positioned respectively on inner side walls of the arms of the first insulating housing, each of the pair of first card latches having a first main body from which a first extension extends, the first main body and the first extension having a plurality of third connectors corresponding to the plurality of first connectors, the first main body having a first clutch extending from an upper edge of a rear end thereof for clutching the at least one electronic card, a first pressing portion extending upwardly from the first clutch;

a pair of second card latches positioned respectively on inner side walls of the arms of the second insulating housing, each of the pair of second card latches having a second main body from which a second extension branches out, the second main body and the second extension having another plurality of third connectors corresponding to the plurality of first connectors, the second main body having a second clutch extending from an upper edge of a rear end thereof for clutching another electronic card and a linking plate extending downwardly from a lower edge of the rear end thereof and positioned between the first main body and the first extension of the first insulating housing, a second pressing portion extending horizontally from the second clutch; and a pair of fasteners having a plurality of fourth connectors corresponding to the plurality of second connectors positioned along outer sides of the first insulating housing and second insulating housing for fastening the stackably mounted first insulating housing and second insulating housing;

wherein the first clutch tilts upwardly by pressing the first pressing portion of each of the pair of first card latches so that the first main body can be slanted to push the linking plate positioned between the first main body and the first extension to cause an upward tilt of the second clutch, thereby the electronic cards installed in the first insulating housing and the second insulating housing can be ejected simultaneously.

2. The stacked card-edge connector according to claim 1, wherein the stackably mounted insulating housings form a stair-shaped configuration.

3. The stacked card-edge connector according to claim 2, wherein the circuit board is a sinking type circuit board.

4. The stacked card-edge connector according to claim 1, wherein each of the pair of fasteners includes a bent portion extending from a front end thereof and perpendicular to the arms of the two insulating housings.

5. The stacked card-edge connector according to claim 4, wherein the bent portion has a locking portion extending forwardly therefrom and perpendicular thereto.

6. The stacked card-edge connector according to claim 5, wherein the locking portion is configured to lock the connector set having the stackably mounted insulating housings to the circuit board.

7. The stacked card-edge connector according to claim 1, wherein the fastener includes additional reinforcing members at an upper edge and a lower edge thereof, and the arms of the two insulating housings includes corresponding recesses at the top surfaces and outer sides of a bottom surfaces thereof to receive the reinforcing members.

8. The stacked card-edge connector according to claim 7, wherein the reinforcing members are of a substantially elongated shape, a substantially Γ shape or a substantially inverted L shape.

9. A stacked card-edge connector for fixing and electrically connecting at least one electronic card to a circuit board comprising:

a connector set having two stackable insulating housings that are interchangeable;

a pair of first card latches mounted respectively at the two sides of one of the two stackable insulating housings for securing the at least one electronic card;

a pair of second card latches secured respectively at the two sides of the other insulating housing for securing another electronic card; and a pair of fasteners for fastening the stackably insulating housings of the connector set;

wherein when the two electronic cards are secured respectively by the pair of first card latches and the pair of second card latches;

wherein ejection of the electronic card installed in a lower level of the stacked card-edge connector from the pair of first card latches causes ejection of the electronic card installed in an upper level of the stacked card-edge connector from the pair of second card latches.

10. The stacked card-edge connector according to claim 9, wherein the stackably mounted insulating housings form a stair-shaped configuration.

11. The stacked card-edge connector according to claim 10, wherein the circuit board is a sinking type circuit board.

12. The stacked card-edge connector according to claim 9, wherein each of the pair of fasteners includes a bent portion extending from a front end thereof and perpendicular to the arms of the two insulating housings.

13. The stacked card-edge connector according to claim 12, wherein the bent portion has a locking portion extending forwardly therefrom and perpendicular thereto.

14. The stacked card-edge connector according to claim 13, wherein the locking portion is configured to lock the connector set having the stackably mounted insulating housings to the circuit board.

15. The stacked card-edge connector according to claim 9, wherein the fastener includes additional reinforcing members at an upper edge and a lower edge thereof, and the arms of the two insulating housings includes corresponding recesses at the top surfaces and outer sides of a bottom surfaces thereof to receive the reinforcing members.

16. The stacked card-edge connector according to claim 15, wherein the reinforcing members are of a substantially elongated shape, a substantially Γ shape or a substantially inverted L shape.

17. A card latching device, comprising:

a first insulating housing positioned in a lower level of the card latching device;

a second insulating housing stacked on top of the first insulating housing and positioned in an upper level of the card latching device;

a pair of first card latches secured respectively at two corresponding side arms of the first insulating housing and a pair of second card latches secured respectively at two corresponding side arms of the second insulating housing;

wherein disengagement of an electronic card installed in the lower level from the pair of first card latches will cause a simultaneous disengagement of another electronic card installed in the upper level of the stacked card-edge connector from the pair of second card latches.

18. The card latching device according to claim 17, wherein the pair of first card latches are secured respectively along the inner side walls of the arms of one insulating housing.

19. The card latching device according to claim 18, wherein each of the pair of first card latches includes a first main body from which a first extension branches out, the first main body and the first extension include a plurality of third connectors.

20. The card latching device according to claim 19, wherein the first main body includes a first clutch extending from an upper edge of a rear end thereof for clutching one of the two electronic cards, and a first pressing portion extends upwardly from the first clutch.

21. The card latching device according to claim 20, wherein the pair of second card latches are secured respectively along the inner side walls of the arms of the other insulating housing.

22. The card latching device according to claim 21, wherein each of the pair of second card latches includes a second main body from which a second extension branches out, the second main body and the second extension include a plurality of second connectors.

23. The card latching device according to claim 22, wherein the second main body includes a second clutch extending from an upper edge of a rear end thereof for clutching the other electronic card and a linking plate extending downwardly from a lower edge of the rear end thereof and positioned between the first main body and the first extension.

24. The card latching device according to claim 23, wherein a second pressing portion extends horizontally from the second clutch.

25. The card latching device according to claim 24, wherein a pair of fasteners includes a plurality of fourth connectors corresponding to the plurality of second connectors positioned along outer sides of the two insulating housings.

26. The card latching device according to claim 25, wherein the first clutch tilts upwardly by pressing the first pressing portion of each of the pair of first card latches so that the first main body can be slanted to push the linking plate positioned between the first main body and the first extension to cause an upward tilt of the second clutch, thereby the electronic cards installed in the first insulating housing and the second insulating housing can be ejected simultaneously.

* * * * *